US006672970B2

(12) United States Patent
Barlow

(10) Patent No.: US 6,672,970 B2
(45) **Date of Patent: *Jan. 6, 2004**

(54) PORTABLE GOLF PUTTING PRACTICE GREEN

(76) Inventor: David R. Barlow, 7620 Harborview Way N., Seminole, FL (US) 33776

( * ) Notice: Subject to any disclaimer, the term of this patent is extended or adjusted under 35 U.S.C. 154(b) by 0 days.

This patent is subject to a terminal disclaimer.

(21) Appl. No.: 10/072,257

(22) Filed: Feb. 7, 2002

(65) Prior Publication Data

US 2003/0148813 A1 Aug. 7, 2003

(51) Int. Cl.[7] ..... A63B 69/36
(52) U.S. Cl. ..... 473/160; 473/162; 473/163
(58) Field of Search ..... 473/157–164

(56) References Cited

U.S. PATENT DOCUMENTS

| | | | | |
|---|---|---|---|---|
| 1,914,365 A | | 6/1933 | Ford | |
| 2,515,847 A | | 7/1950 | Winkler | |
| 3,661,687 A | | 5/1972 | Spinney, Jr. | |
| 3,669,454 A | | 6/1972 | Kolonel | |
| 3,715,123 A | | 2/1973 | Baum | |
| 3,727,918 A | | 4/1973 | Zawacki | |
| 3,743,295 A | | 7/1973 | Flowers | |
| 3,871,650 A | | 3/1975 | Casey | |
| 3,871,661 A | * | 3/1975 | Korff | 473/160 |
| 4,202,547 A | | 5/1980 | Mueller | |
| 4,211,417 A | | 7/1980 | Brown | |
| 4,244,576 A | * | 1/1981 | Mosier et al. | 473/159 |
| 4,596,391 A | * | 6/1986 | Carolan, Jr. | 473/158 |
| 5,002,280 A | * | 3/1991 | Hines | 473/160 |
| 5,007,644 A | | 4/1991 | Bluthardt et al. | |
| 5,042,813 A | * | 8/1991 | Huang | 473/153 |
| 5,171,016 A | * | 12/1992 | Kamal | 473/160 |
| 5,366,224 A | | 11/1994 | Stanwyck et al. | |
| 5,916,034 A | | 6/1999 | Lancia | |
| 6,302,803 B1 | | 10/2001 | Barlow | |
| 6,338,682 B1 | | 1/2002 | Torchia et al. | |
| 6,413,166 B1 | * | 7/2002 | Long | 473/160 |

FOREIGN PATENT DOCUMENTS

| | | | |
|---|---|---|---|
| EP | 160952 | * | 5/1984 |

* cited by examiner

*Primary Examiner*—Mark S. Graham
(74) *Attorney, Agent, or Firm*—Larson & Larson, PA; James E. Larson

(57) ABSTRACT

Multiple molded polymeric panels are mechanically fastened together in a lengthwise configuration with a backboard at one end opposite the starting position for a putting stroke. Each panel has a planar top surface and a bottom integral grid supporting structure. The side edges of the panels are raised and the panels are attached together end to end. A simulated grass overlies the joined panels and a receptacle for receiving a golf ball is provided in one panel. A first carrying case contains the panels and backboard and a second carrying case contains the simulated grass and simulated flag stick.

14 Claims, 28 Drawing Sheets

PORTABLE GOLF PUTTING PRACTICE GREEN

FIELD OF THE INVENTION

This invention relates to practice golf putting greens. More particularly, it refers to a portable lengthwise putting green wherein sectional panels are held together by mechanical locking features.

BACKGROUND OF THE INVENTION

The expanding interest in golf has created a demand for golf practice tools, particularly putting greens. The ability to putt accurately distinguishes the ordinary golfer from the skilled golfer. With an interest in improving golf putting skills, the portable golf putting green of U.S. Pat. No. 6,302,803 was developed. Although the portable golf putting green described in this patent has been commercially accepted and serves its intended purpose, a need exists for variations that suit particular markets.

SUMMARY OF THE INVENTION

The invention of this application is a series of one piece sectional polymeric panels attachable by locking features to adjacent panels in a lengthwise direction. The lengthwise fastened together panels are covered by a simulated grass layer to create a putting surface simulating a putting green. The one piece sectional polymeric panels are prepared by compression, blow, injection or other molding process to prepare a smooth, planar top surface integral with a bottom grid structure. Locking features are mounted at an end of each panel juxtaposed to an adjacent polymeric panel.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
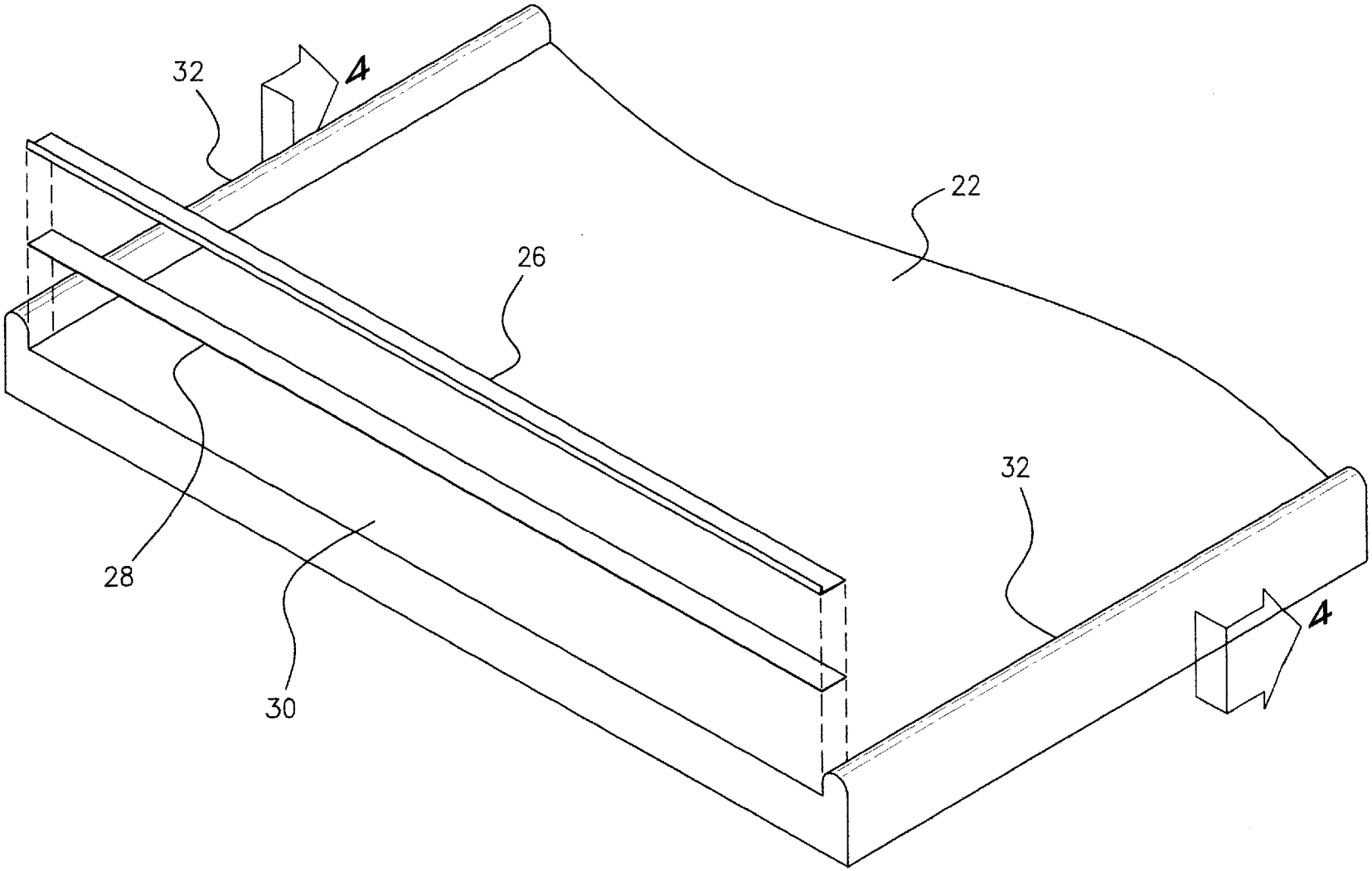
FIG. 1 is a cut-away perspective view of the polymeric panel of this invention showing front edge trim placement.

Throughout the following detailed description, the same reference numerals refer to the same elements in all figures.

Figure 10:
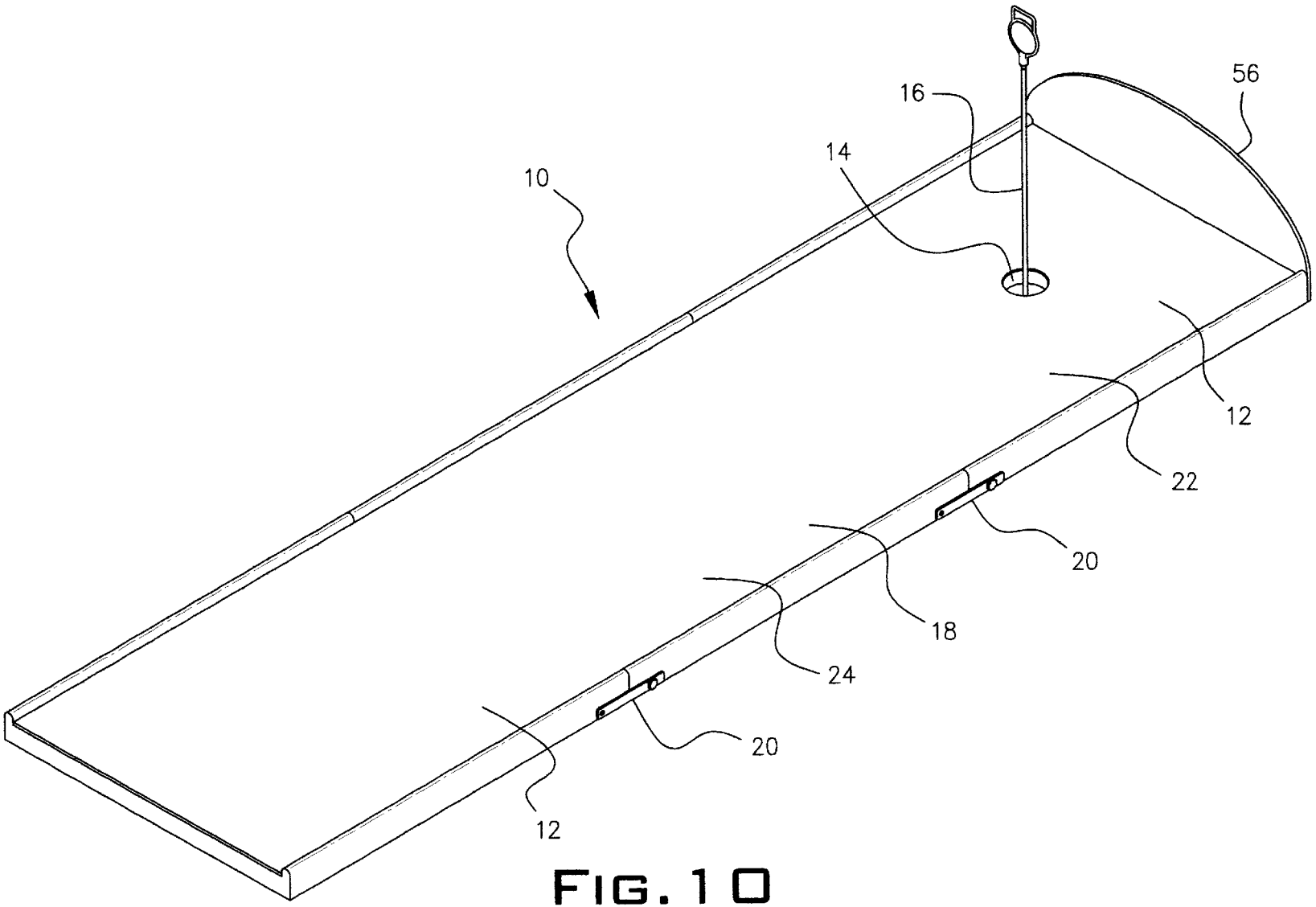
FIG. 10 is a perspective view of the portable golf putting practice green with a first locking mechanism.
Figure 11:
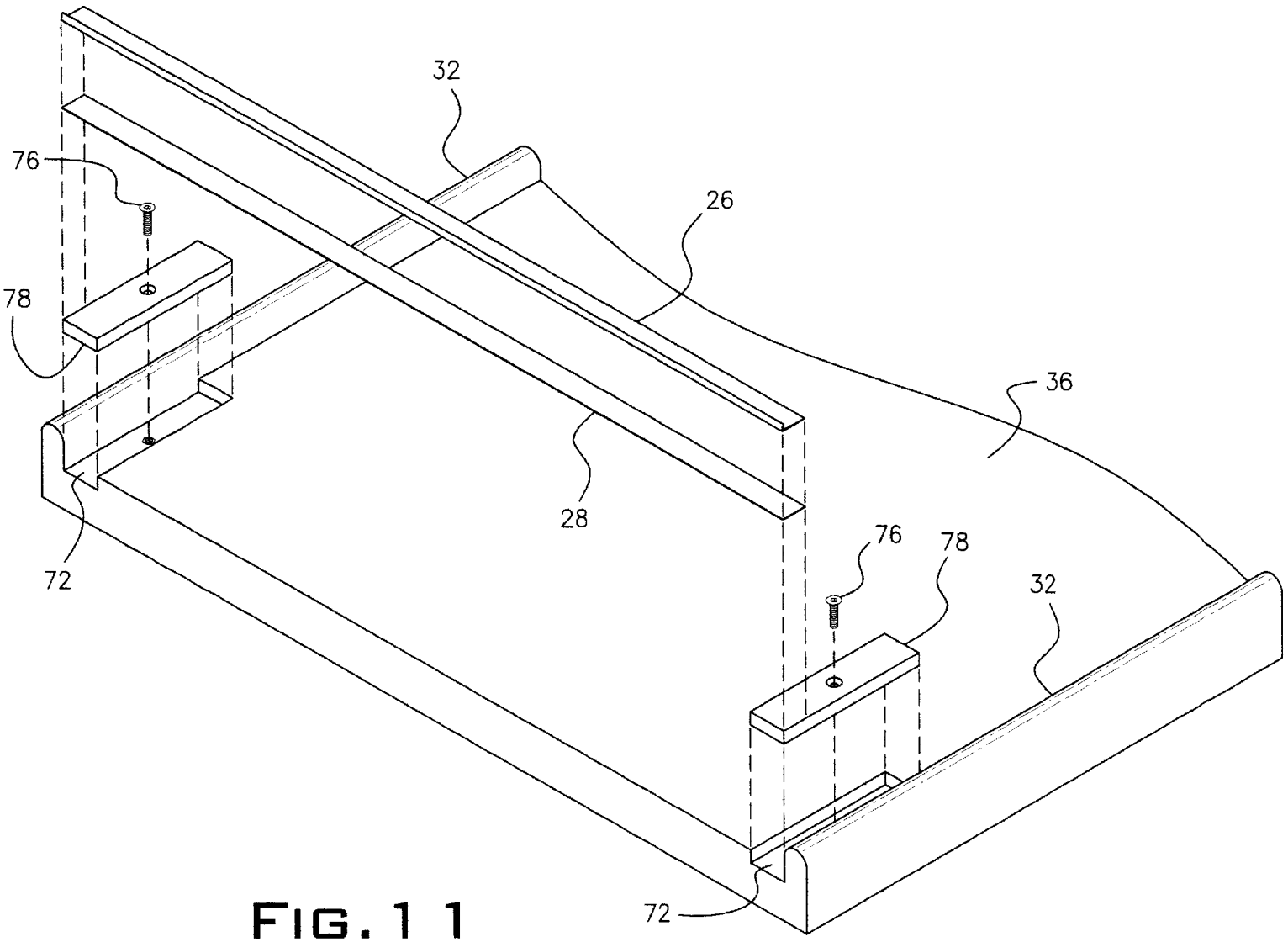
FIG. 11 is an exploded view of a polymeric panel with a filler block at each side edge.
Figure 12:
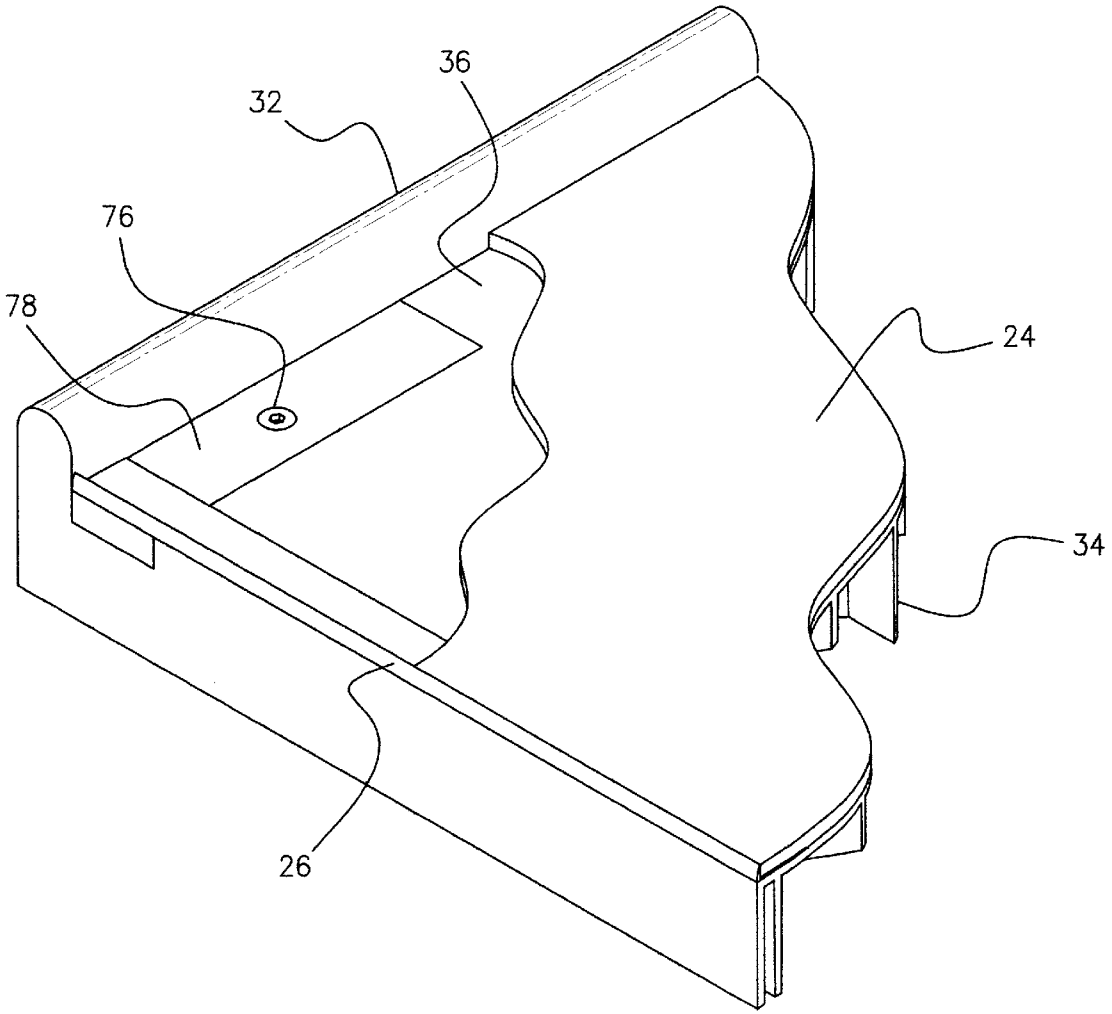
FIG. 12 is a cut-away view of a polymeric panel with an installed filler block.

Referring first to FIG. 10, the portable practice green 10 is a lengthwise unit having three panels mechanically locked together. Two panels or four or more panels could be used alternatively. Each panel is a polymeric unit having a flat top surface portion and an integral grid bottom portion. A front panel 22 usually has a cup 14 for receipt of putted golf balls and a ball remover stand 16. A middle panel 18 is attached by a locking mechanism 20 to front panel 22 and back panel 12. The attached panels are covered by a simulated grass 24.

Figure 2:
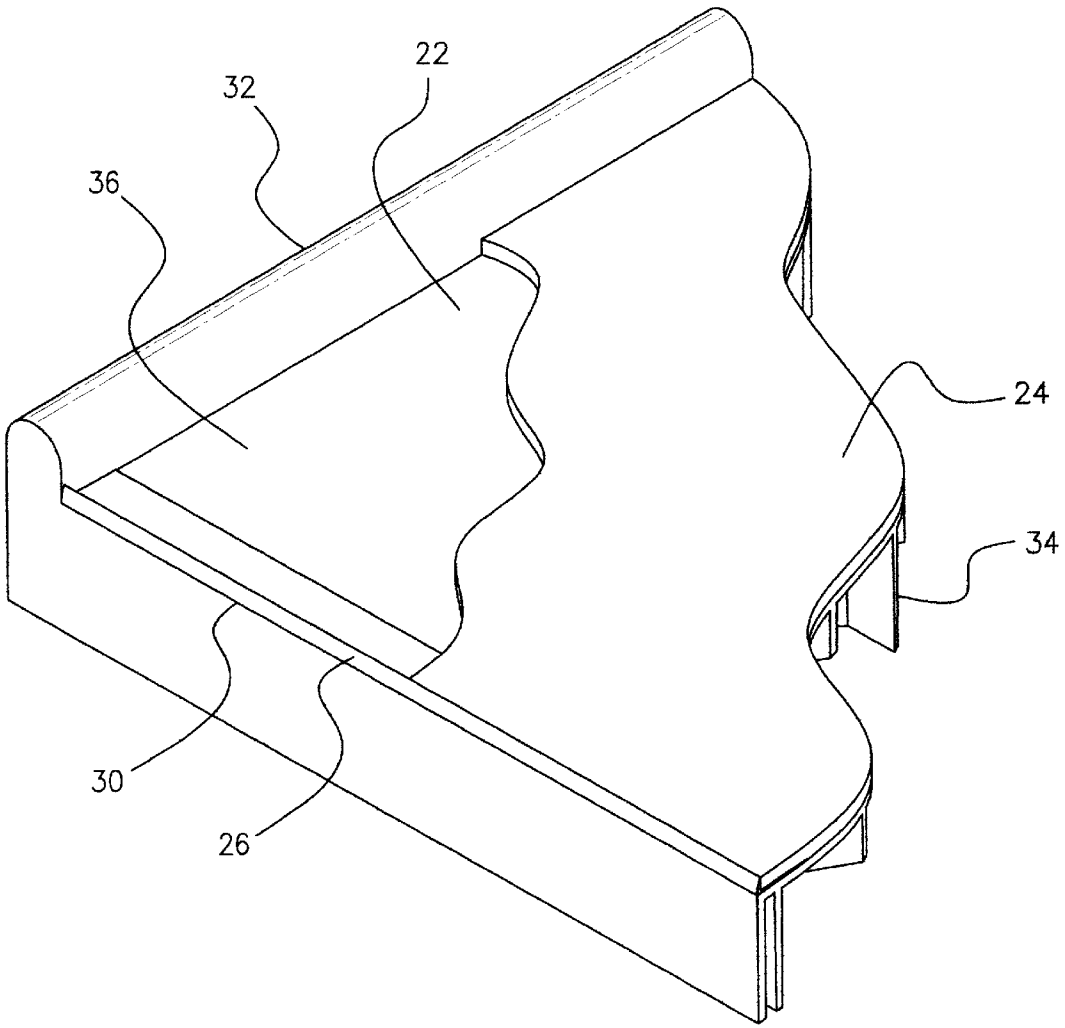
FIG. 2 is a cut-away perspective view of the polymeric panel of FIG. 1 with the edge trim in place covered with simulated grass.
Figure 3:
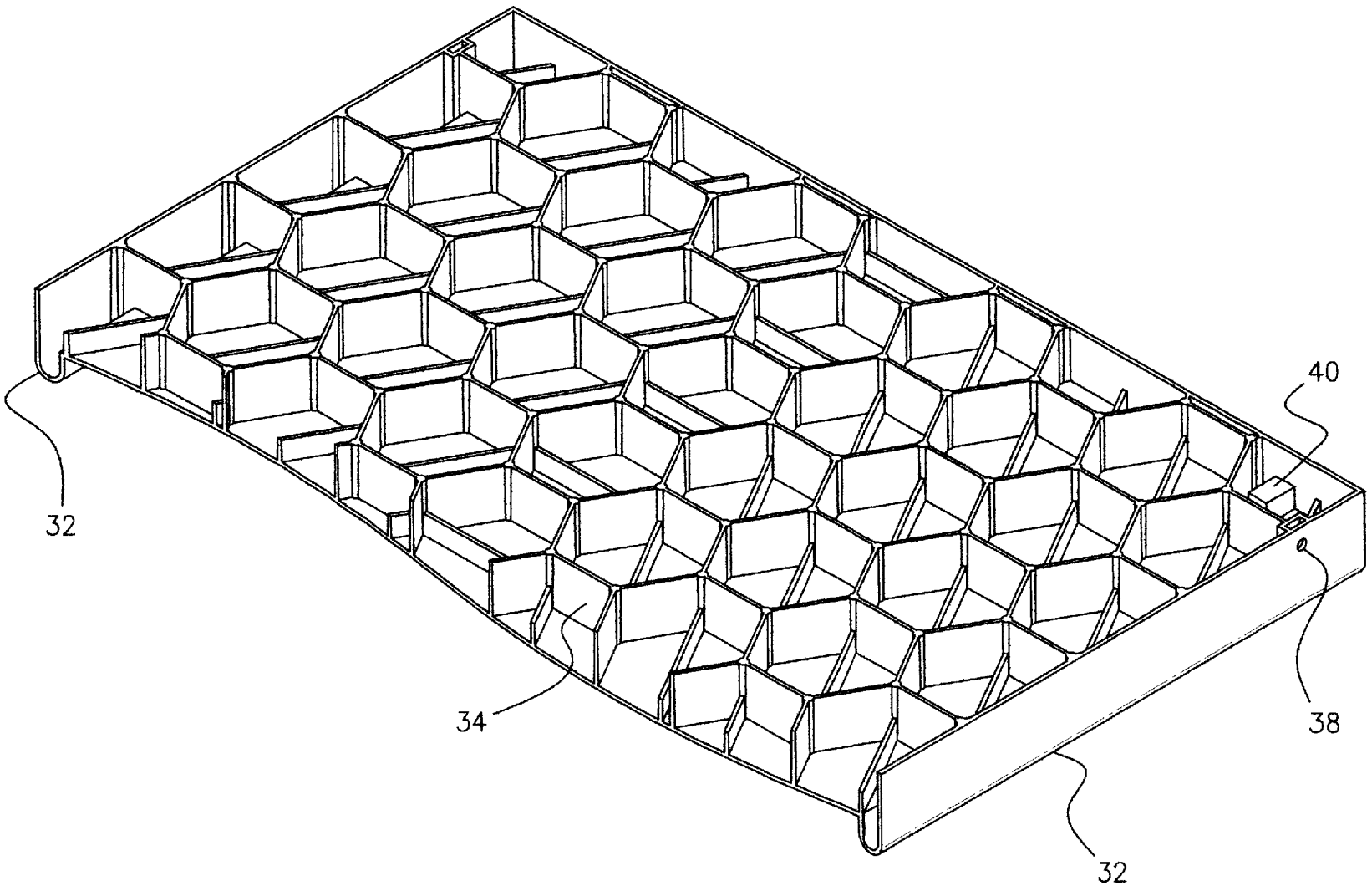
FIG. 3 is a bottom view of the polymeric panel of FIG. 1.
Figure 4:
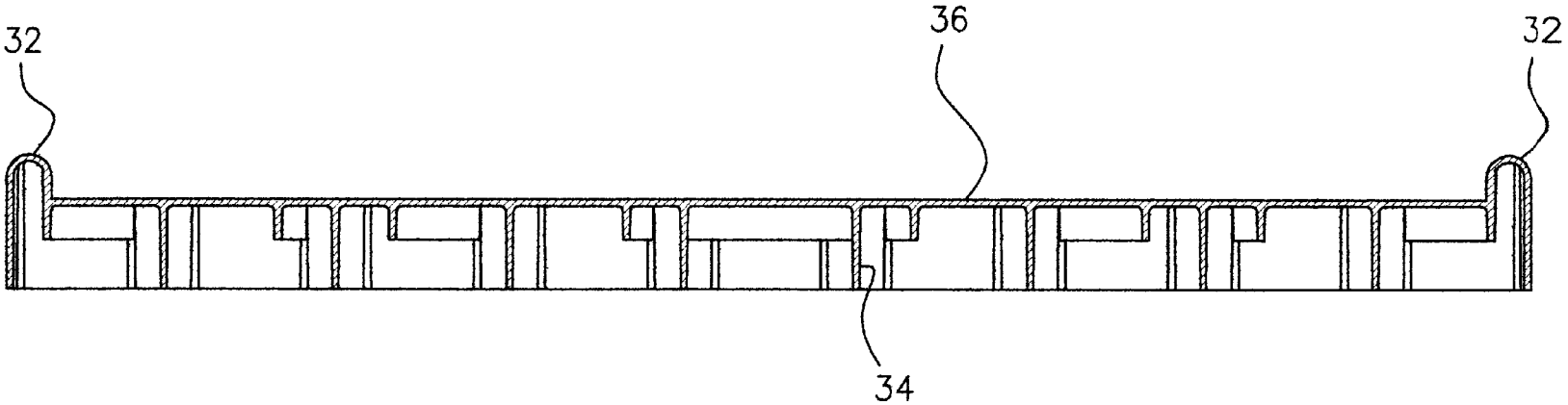
FIG. 4 is a sectional view along line 4—4 of FIG. 1.
Figure 5:
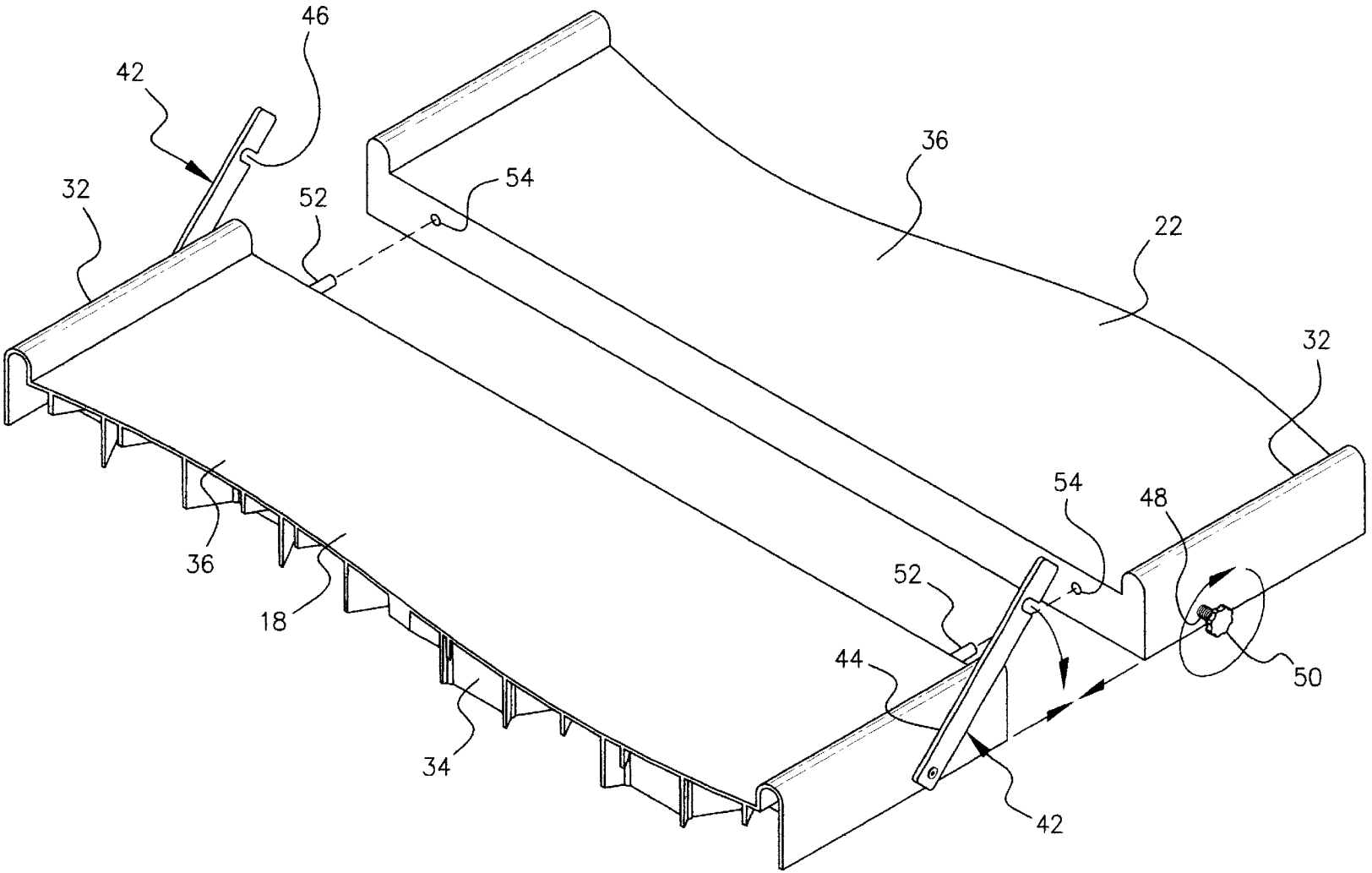
FIG. 5 is a perspective view of two cut-away polymeric panels showing a first locking mechanism.
Figure 6A:
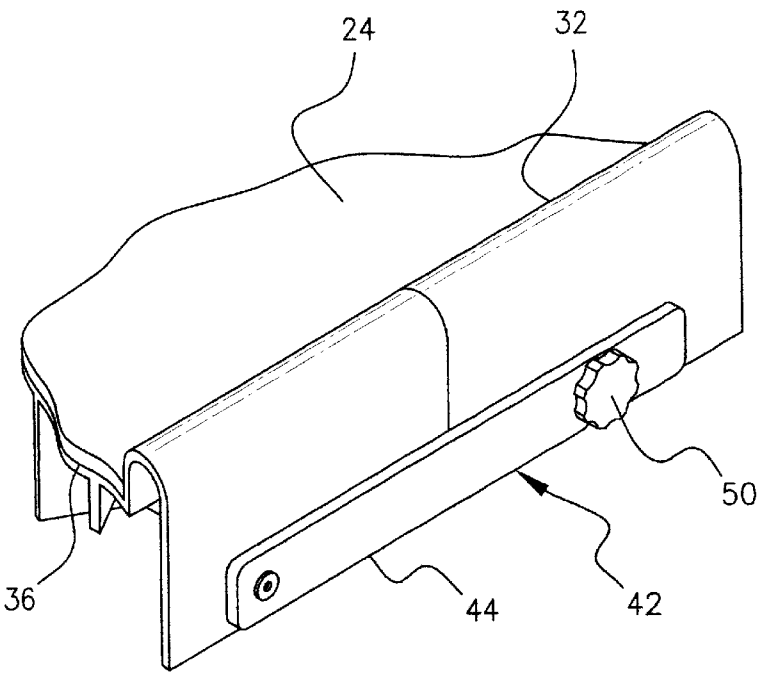
FIG. 6A is a perspective view of a portion of the polymeric panels of FIG. 5 locked together.
Figure 6B:
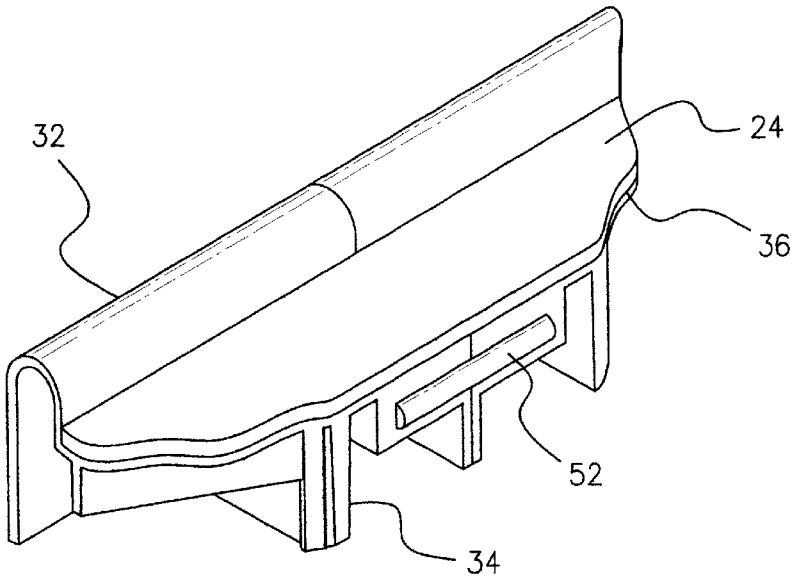
FIG. 6B is a sectional view of a portion of the polymeric panels of FIG. 5 locked together showing the locating pin.

Referring to FIG. 1, the front edge portion 30 of panel 22 has a trim piece 26 attached to the edge portion 30 by a two sided sticky tape 28. The panel has rolled raised edges 32 on each side. As seen in FIG. 2, the simulated grass 24 fits into trim piece 26 to give a clean front edge portion 30 to panel 22. The grid structure 34 integral with the flat top 36 of panel 22 supports the panel as seen in FIGS. 3 and 4. A hole 38 in side edge 32 is adapted for receipt of locking hardware as seen in FIGS. 5, 6A and 6B. A block 40 molded in with the grid structure can receive a locating pin or threaded fastener.

A first locking mechanism 42 as seen in FIGS. 6, 6A and 6B has a bar 44 pivoting at a first end with a groove at a second end portion engaging the shaft 48 of threaded fastener 50 to lock polymeric panels 18 and 22 together. Pins 52 in polymeric panel 18 engage holes 54 in polymeric panel 22 prior to completing the locking step. The pin 52 can be aluminum, plastic or steel and the bar 44 is aluminum, plastic or steel.

Figure 7:
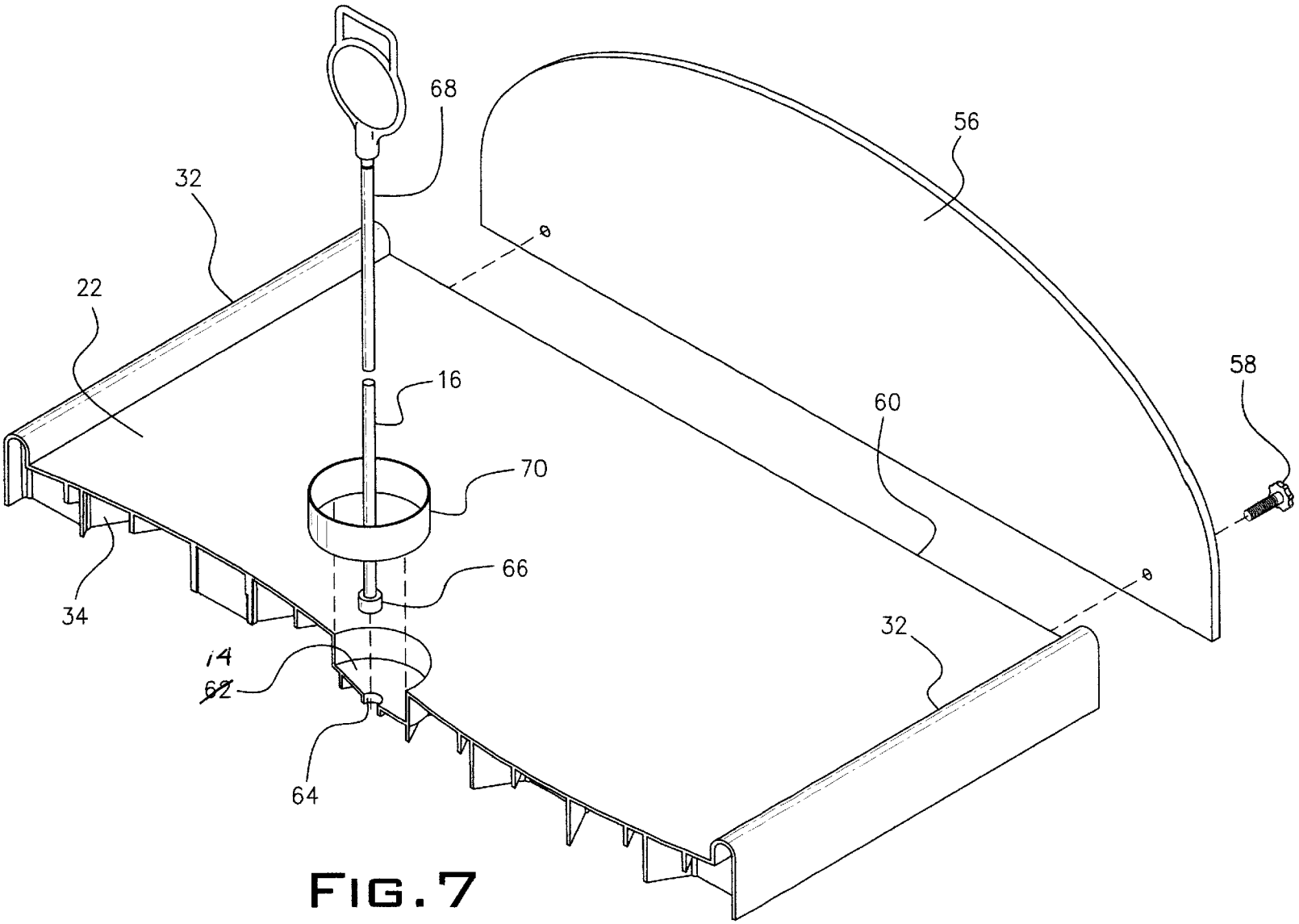
FIG. 7 is a perspective view of a portion of a rear polymeric panel showing a ball cup placement and placement of a backboard.
Figure 8:
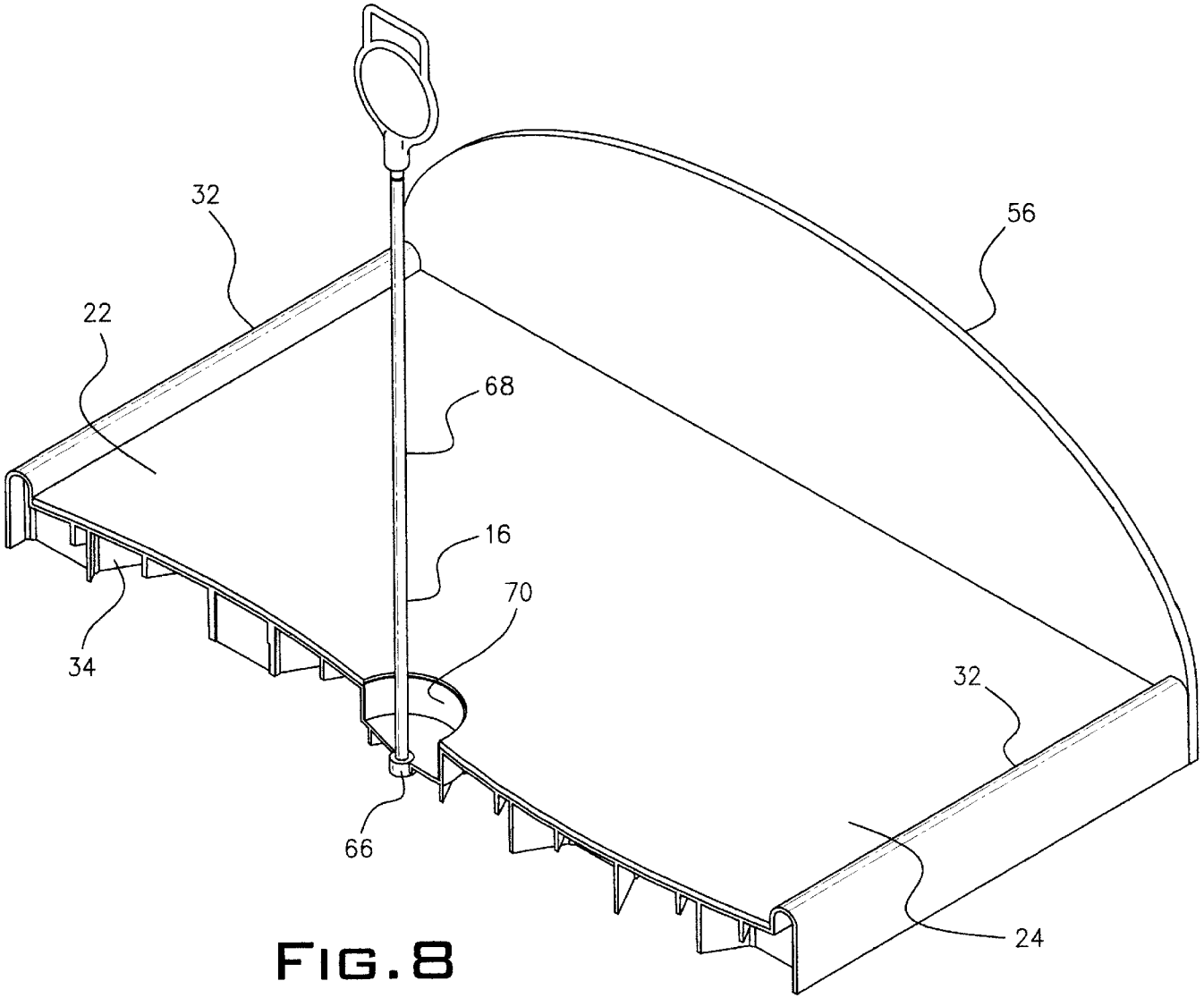
FIG. 8 is a perspective view of the portion of the rear polymeric panel of FIG. 7 with the cup and backboard in position.
Figure 9:
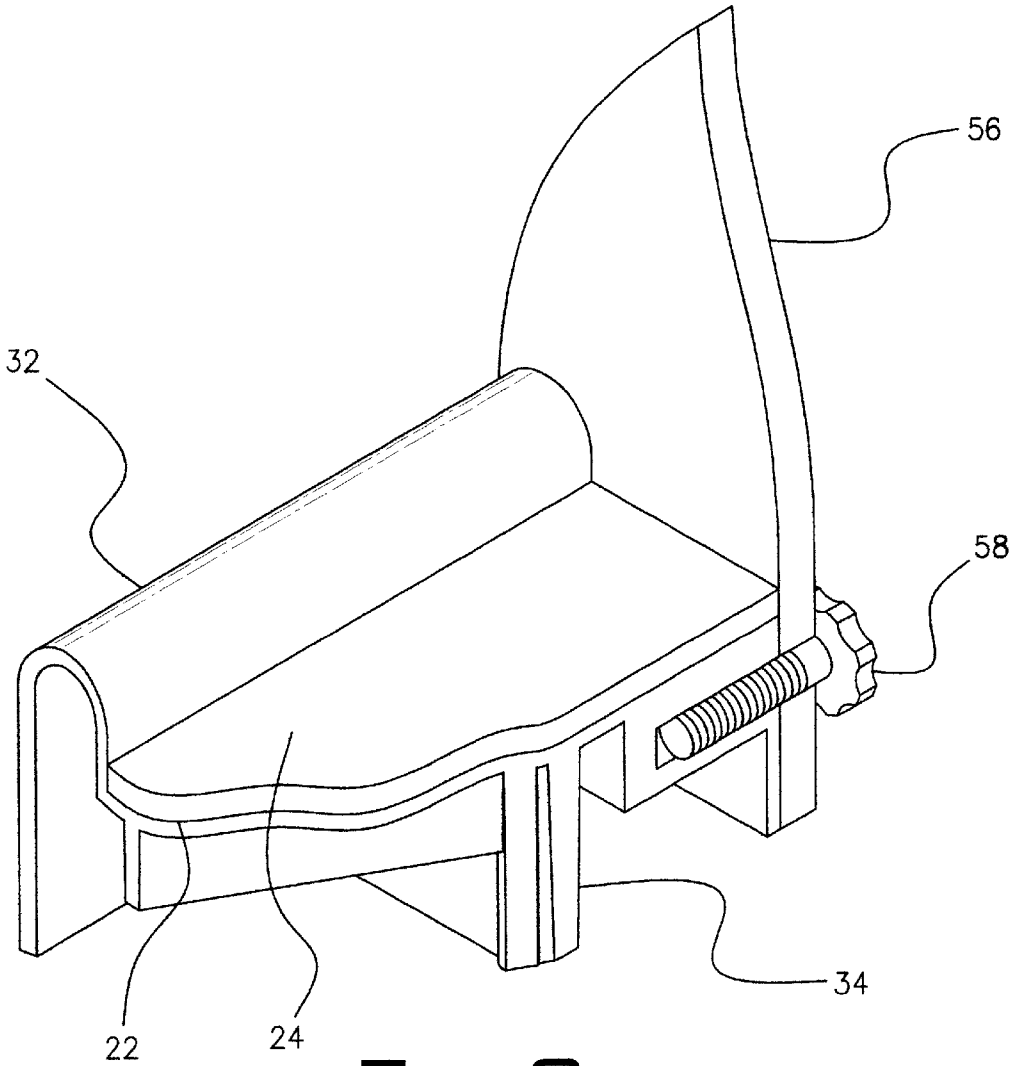
FIG. 9 is a sectional view of the polymeric panel of FIG. 8 showing the backboard attachment.

A backboard 56 is attached by a pair of threaded fasteners 58 to a front end 60 of front panel 22 as shown in FIGS. 7 and 9. The golf ball receiving cup 14 is molded into front polymeric panel 22. A hole 64 in cup 14 receives a terminal ring 66 at the end of a simulated flag stick 68. A cup ring 70 provides a neat edge to cup 14.

Figure 13:
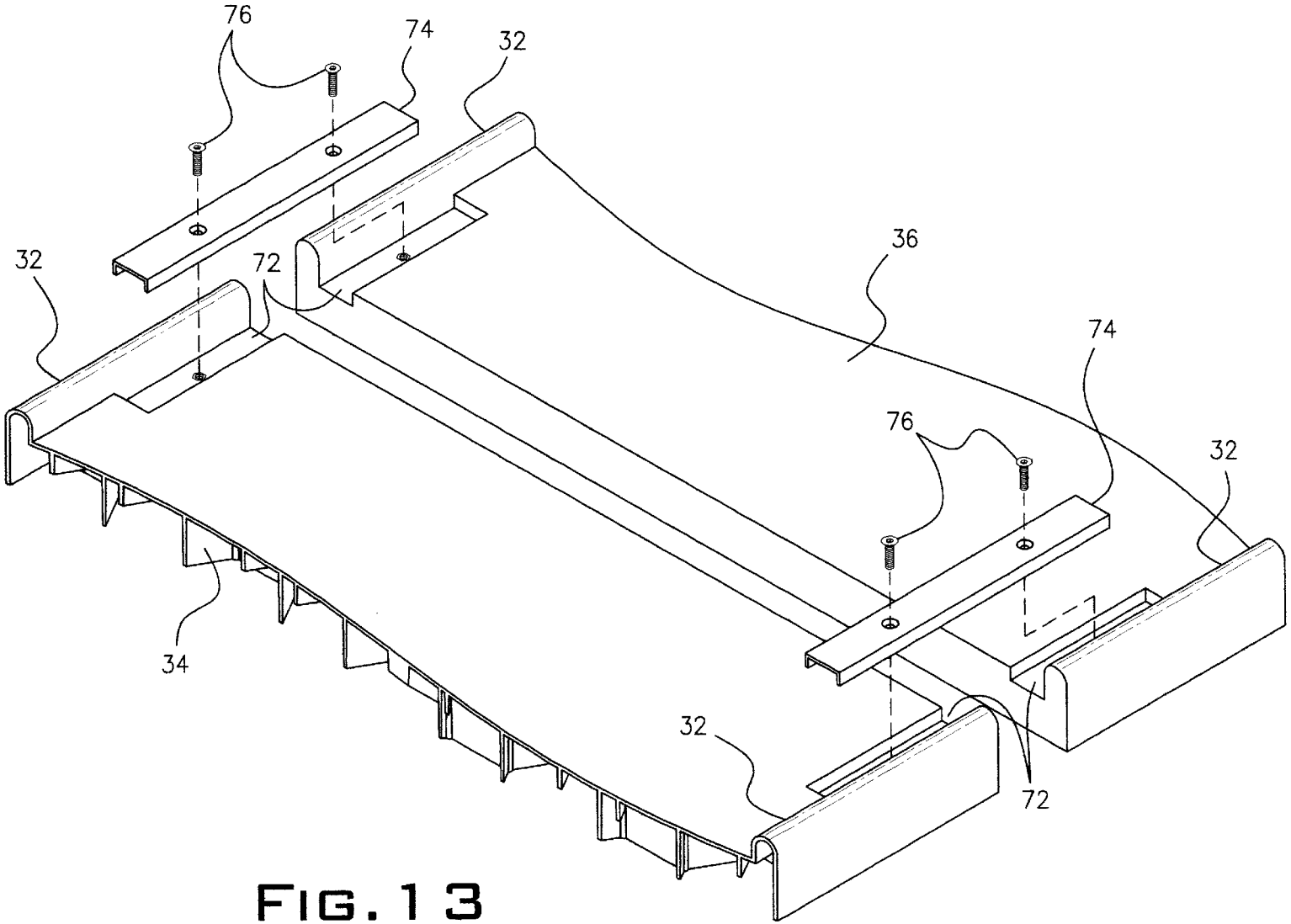
FIG. 13 is a cut-away view of two adjacent polymeric panels with a second locking mechanism in exploded view.
Figure 14:
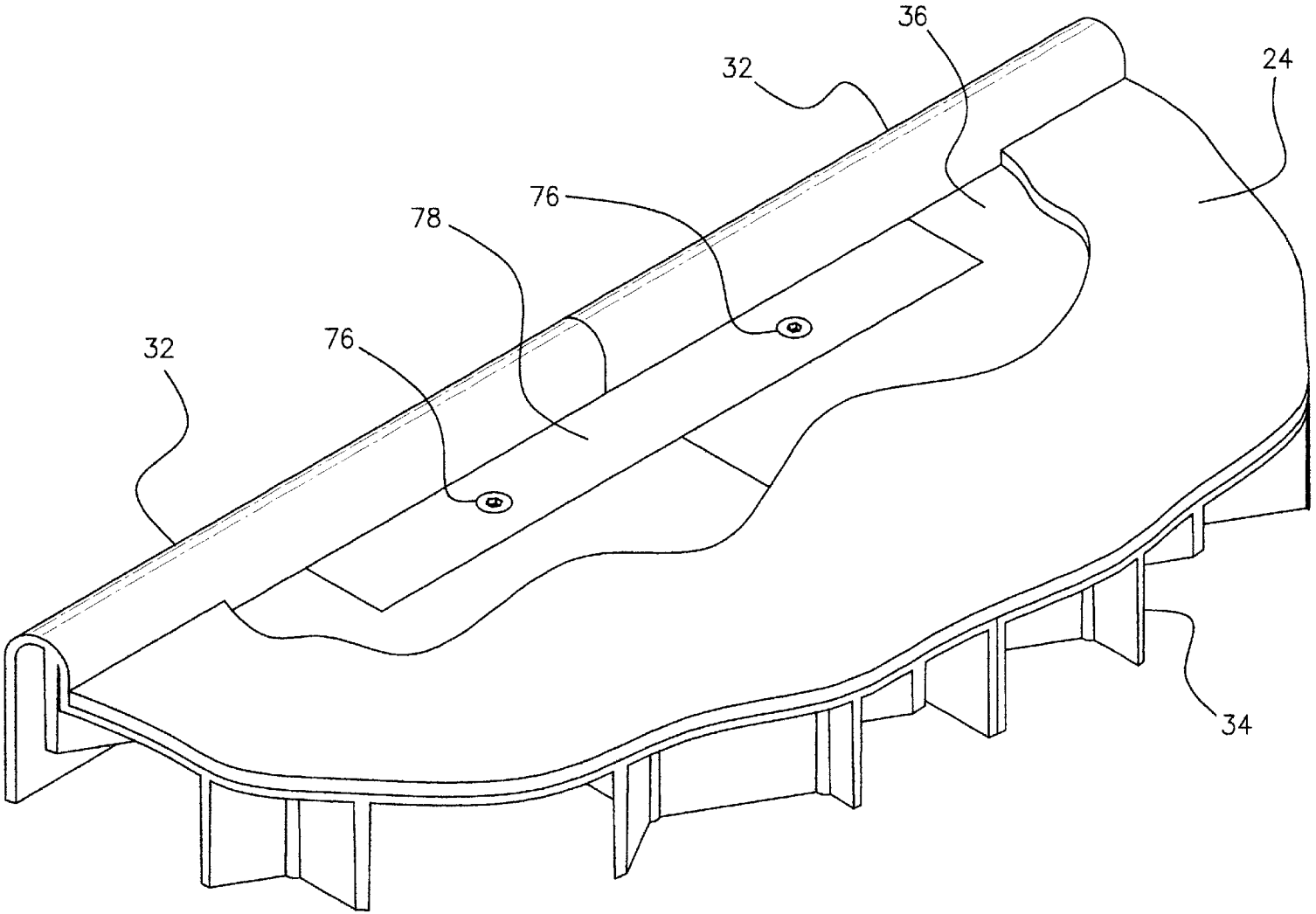
FIG. 14 is a cut-away view of two joined polymeric panels of FIG. 13 with the second locking mechanism.
Figure 15:
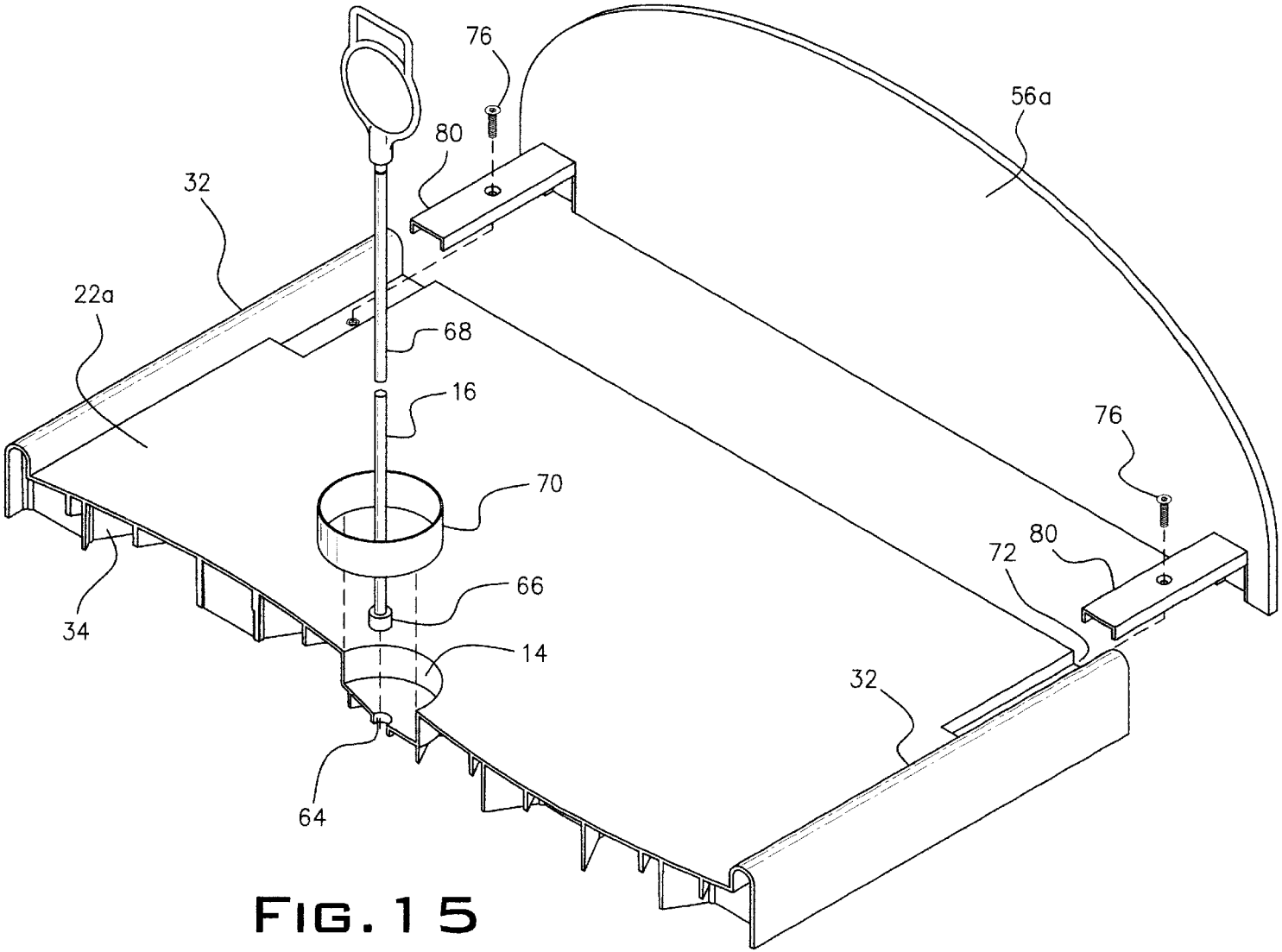
FIG. 15 is a cut-away view of a rear polymeric panel showing an alternate attachment to the backboard.
Figure 16:
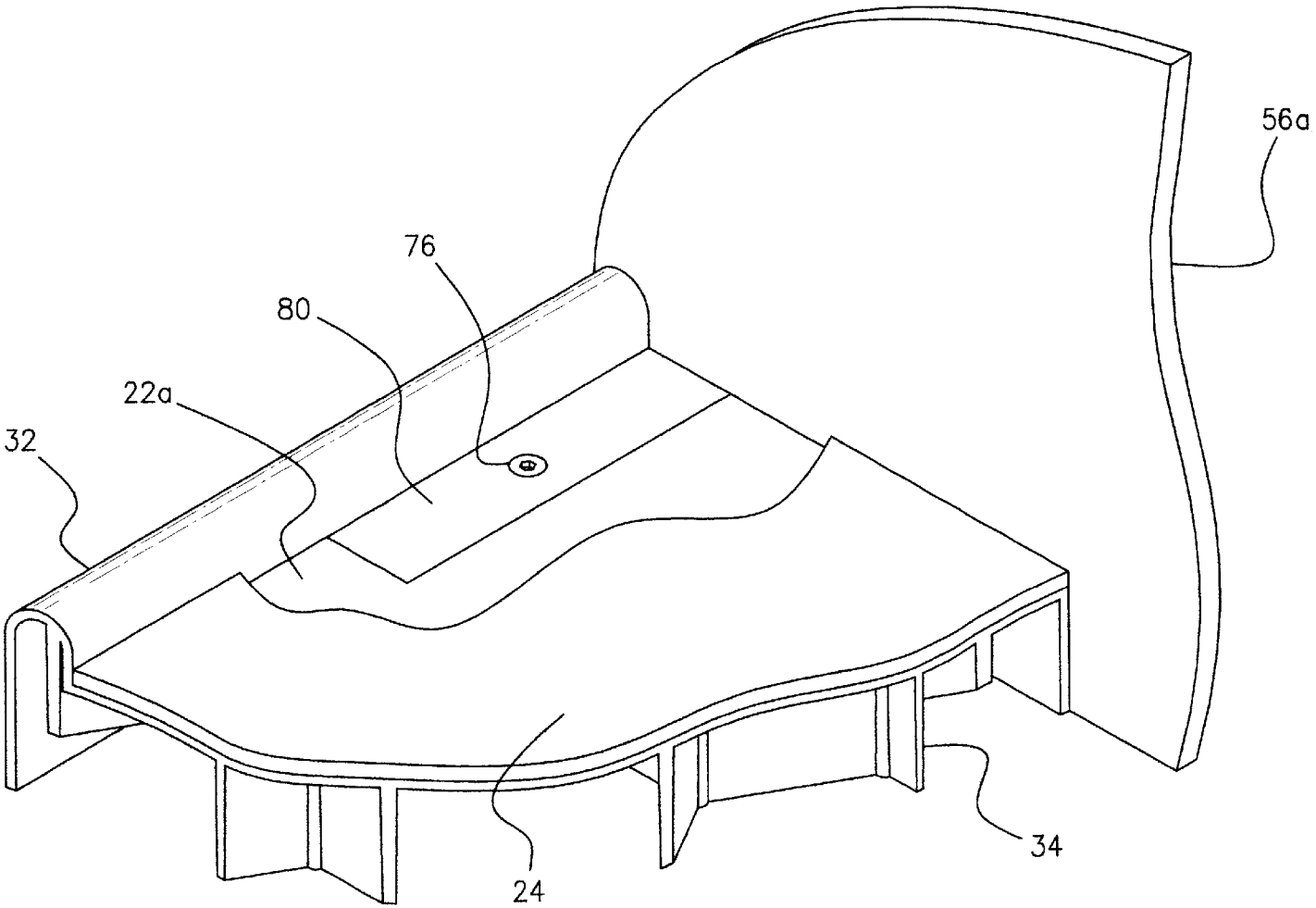
FIG. 16 is a cut-away view of a rear polymeric panel of FIG. 14 showing the backboard attached with a second locking mechanism.

FIGS. 11–14 describe a second means of fastening the polymeric panels together by forming a groove 72 at an edge of each polymeric panel. As seen in FIG. 13, a metal bracket 74 fits into grooves 72 and is held in place by fasteners such as bolts 76. When the groove 72 is not juxtaposed to an adjoining polymeric panel, a filler block 78 is placed in groove 72. Groove 72 of panel 22A can be used to receive an L-bracket 80 attached to a backboard 56A. This provides an alternate manner of attaching the backboard 56A to a front polymeric panel 22A.

Figures 17, 18:
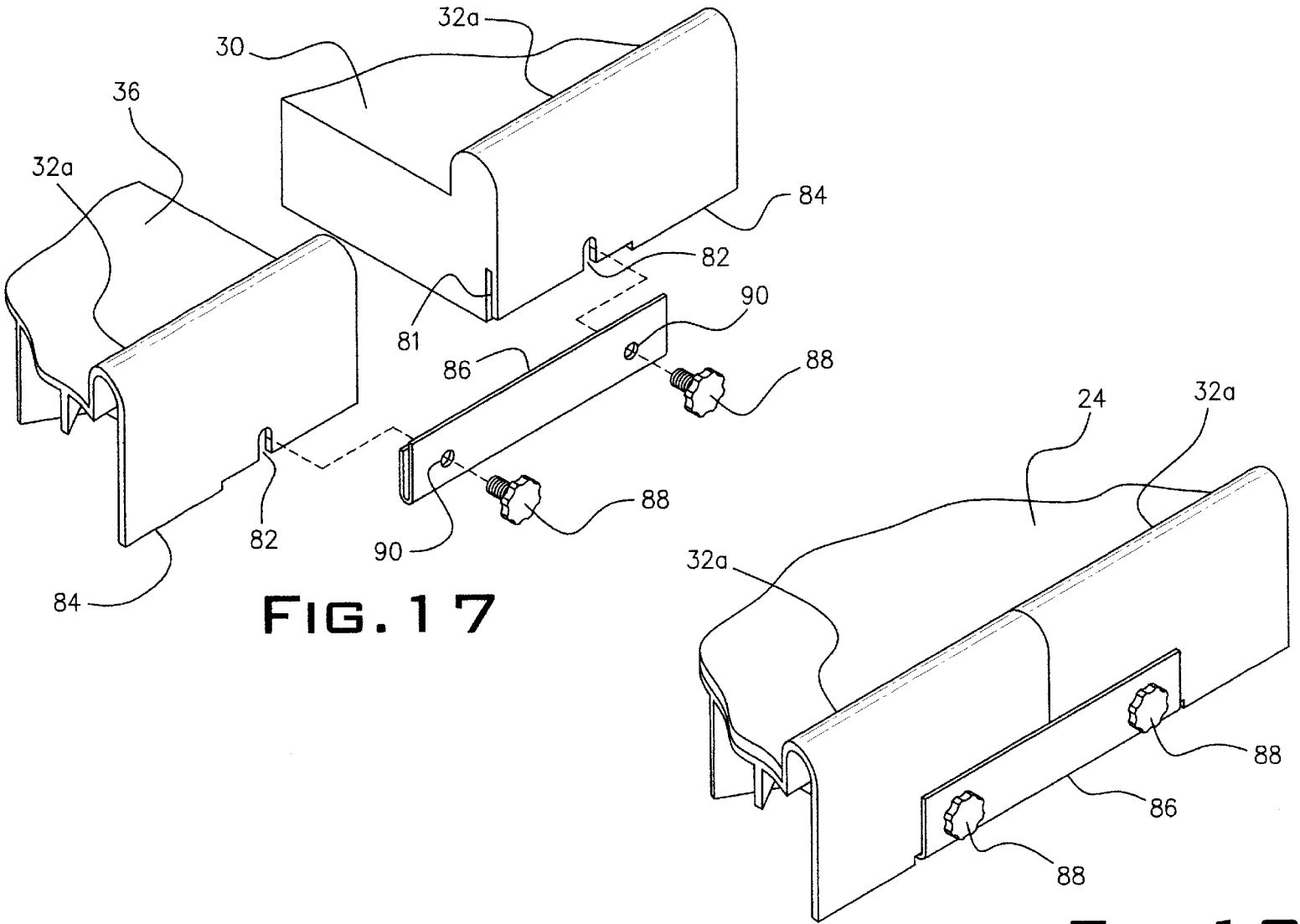
FIG. 17 is a cut-away view of a third locking mechanism for joining two polymeric panels.
FIG. 18 is a cut-away view of the third locking mechanism joining two polymeric panels.

FIGS. 17 and 18 show a third means of locking two polymeric panels together. A slot 82 is formed in a rolled side 32A. In addition, a portion of a bottom edge 84 of side 32 is cut-away and a side slot 81 formed to permit insertion on both an inner and outer bottom edge of side 32A of a U-shaped plate 86. Threaded fasteners 88 pass through holes 90 in plate 86 and through slot 82 to join two polymeric panels together.

Figure 19:
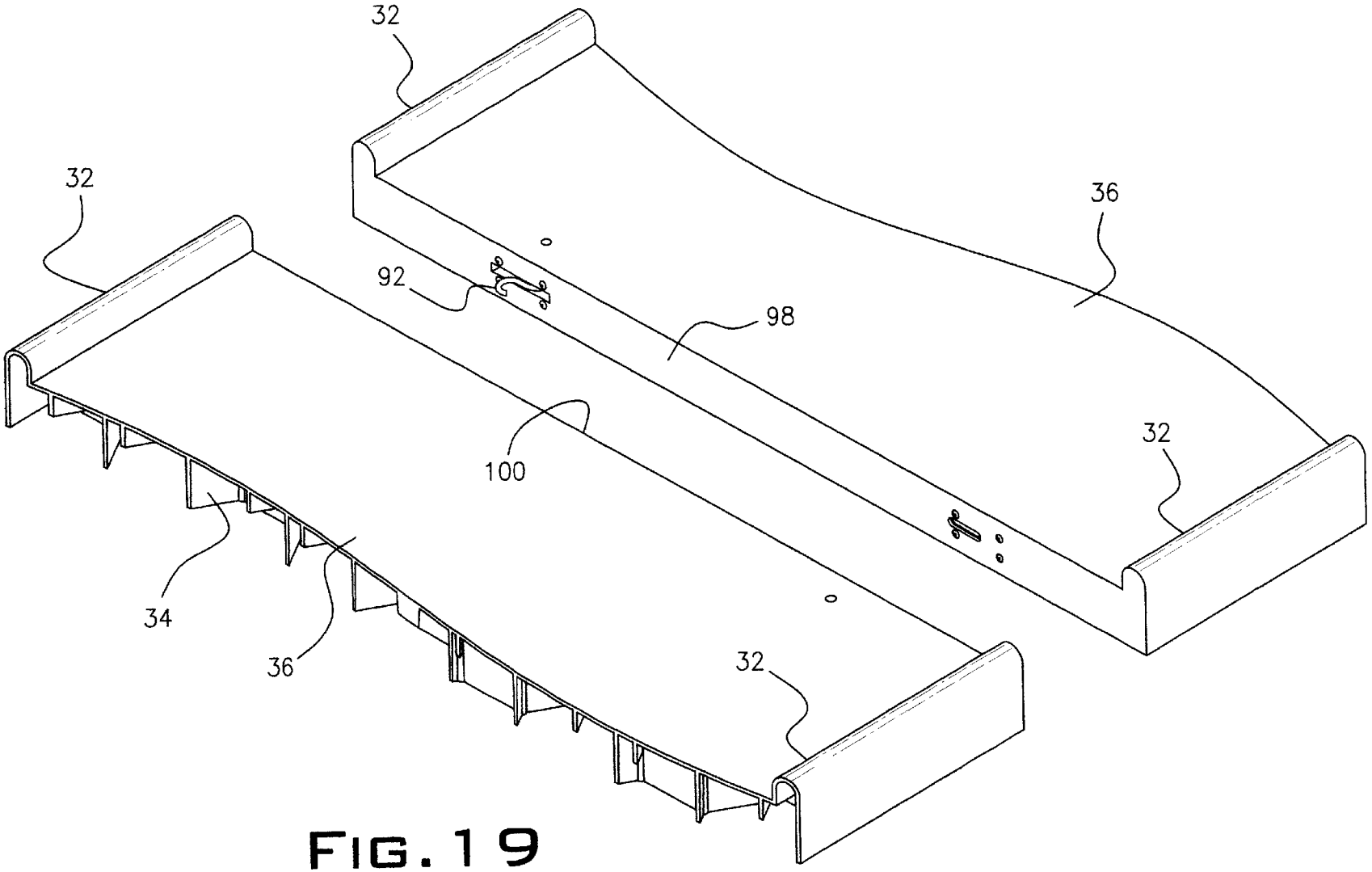
FIG. 19 is a cut-away view of a fourth locking mechanism for joining two polymeric panels.
Figure 20:
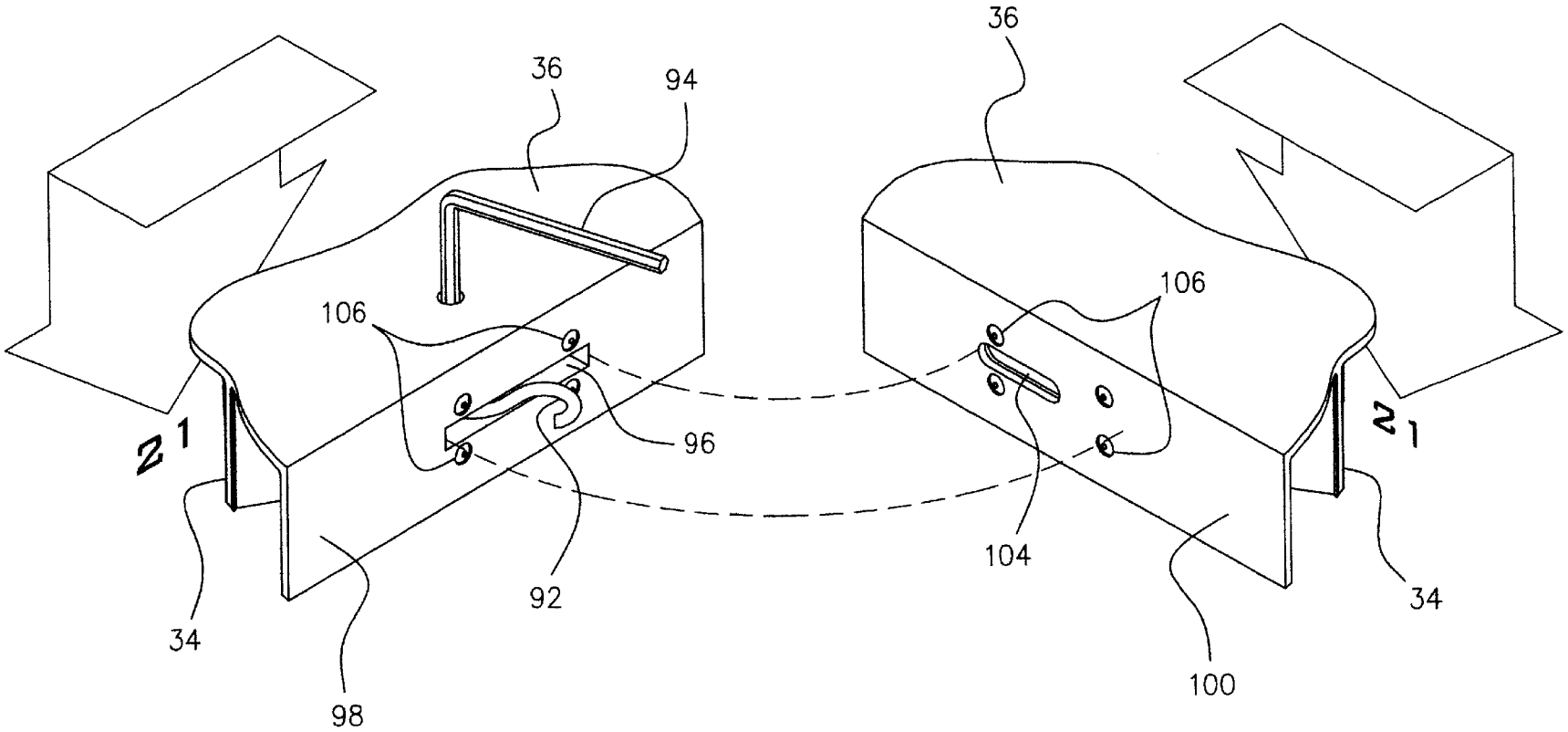
FIG. 20 is a cut-away view of the locking mechanism of FIG. 19.
Figure 21:
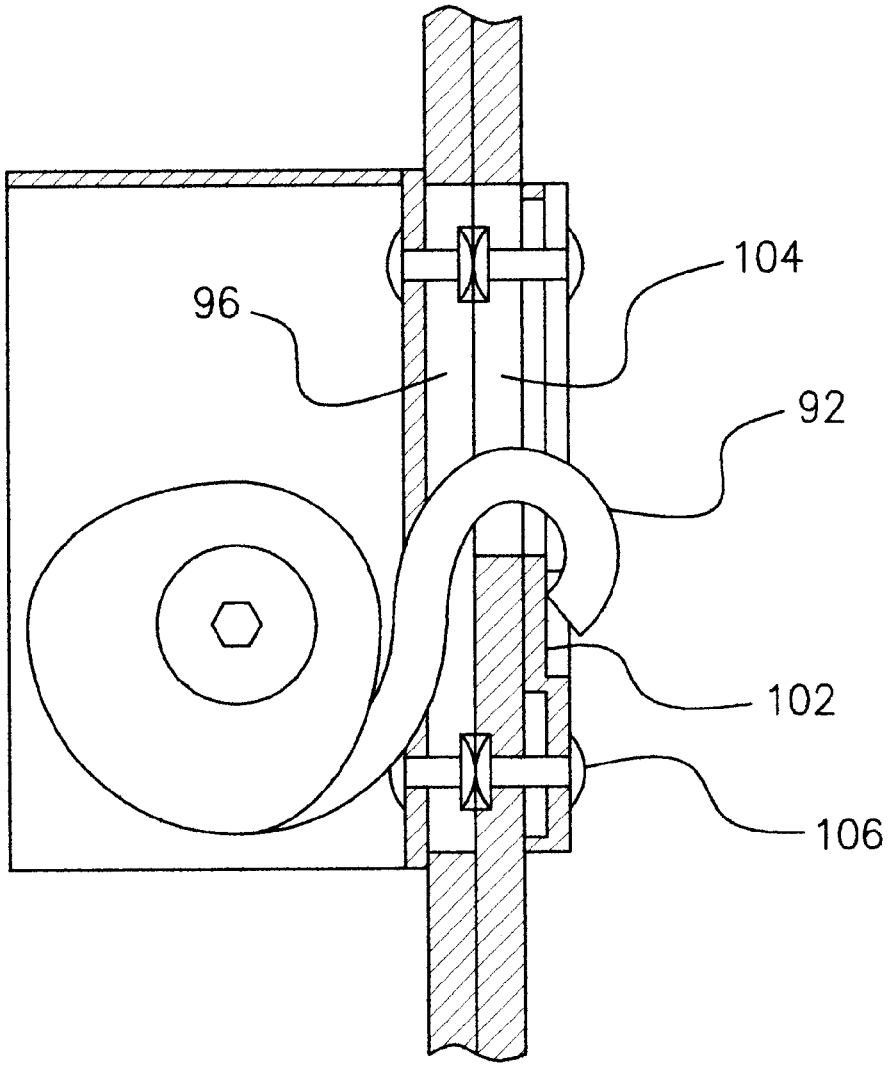
FIG. 21 is a sectional view of the fourth locking mechanism along line 21—21 of FIG. 20.

FIGS. 19–21 show a fourth means of locking two panels together. A cammed S-hook 92 is mounted in a side slot 96 of a polymeric panel side 98. By turning an alien wrench 94, after sides 98 and 100 are brought together, the S-hook 92 engages a back edge 102 in opposite slot 104. Rivets 106 hold the respective components in place. Each of side 98 and 100 has one S-hook and each side has a complimentary slot 104 with a back edge 104 to receive an S-hook 92.

Figure 22:
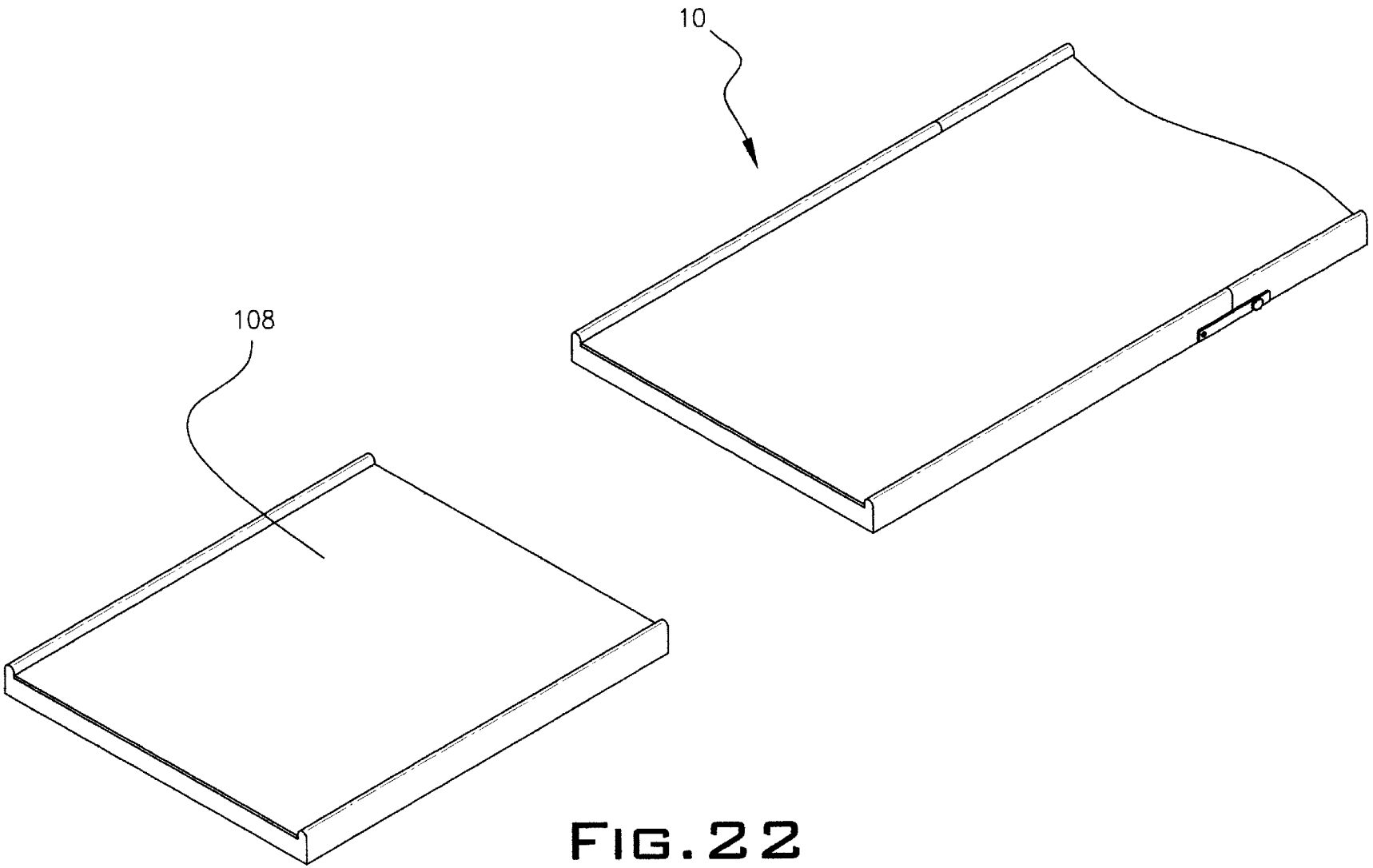
FIG. 22 is a cut-away view of the portable golf putting practice green with a chipping station.

A chipping platform 108 as shown in FIG. 22 provides an area separated from practice green 10 so that a golf ball can be chipped onto the practice green 10. The chipping platform 108 is made in the manner of the polymeric panels in the practice green 10.

Each polymeric panel unit 12, 18 and 22 is compression molded, blow molded or injection molded with a grid structure 34 on a bottom portion integral with a planar top surface 36. Other types of molding of the polymeric panels that can be used include low pressure flow molding, rotational molding, structural foam injection molding and reaction injection molding. Synthetic turf or carpet made of wool fibers or polymer fibers can be used for the simulated grass surface 24 of the putting training green 10 and is laid point to point at the base of the rolled edges 32 and to the trim piece 26. A thicker rug carpet is used on the chipping platform 108 shown in FIG. 22 to simulate a typical chipping surface. The chipping platform 108 is molded in the same manner as the polymeric panels 12, 18 and 22 and has a planar top surface integral with a bottom grid structure.

The polymer employed in the molding and creation of the polymeric panels 12, 18 and 22 or the chipping platform 108 can be any of the high strength polymers such as polyethylene, polypropylene and co-polymers thereof and structural foams such as made from polyurethane.

Figure 23:
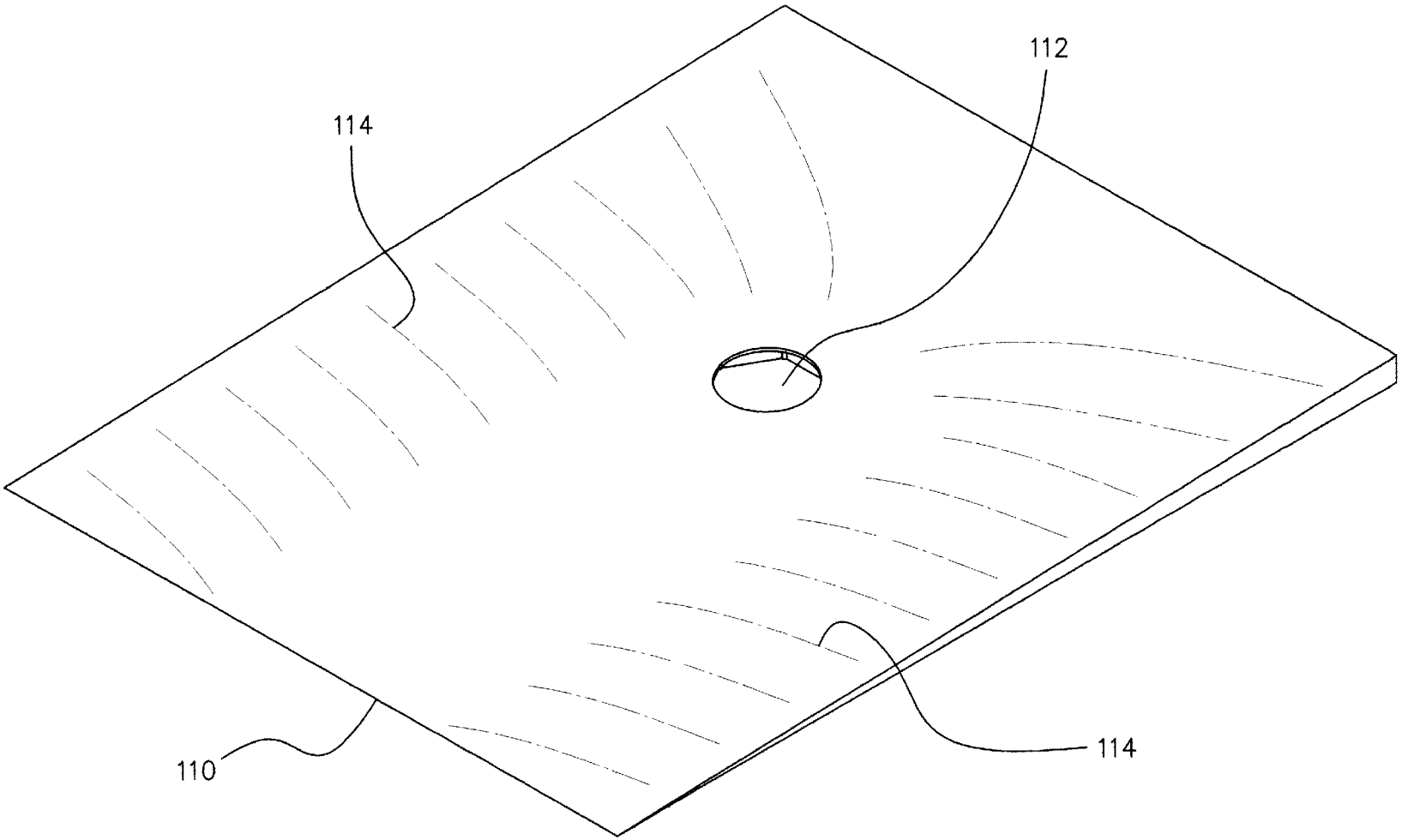
FIG. 23 is a perspective view of a molded polymeric or foam insert for inserting under simulated grass around a cup.
Figure 24:
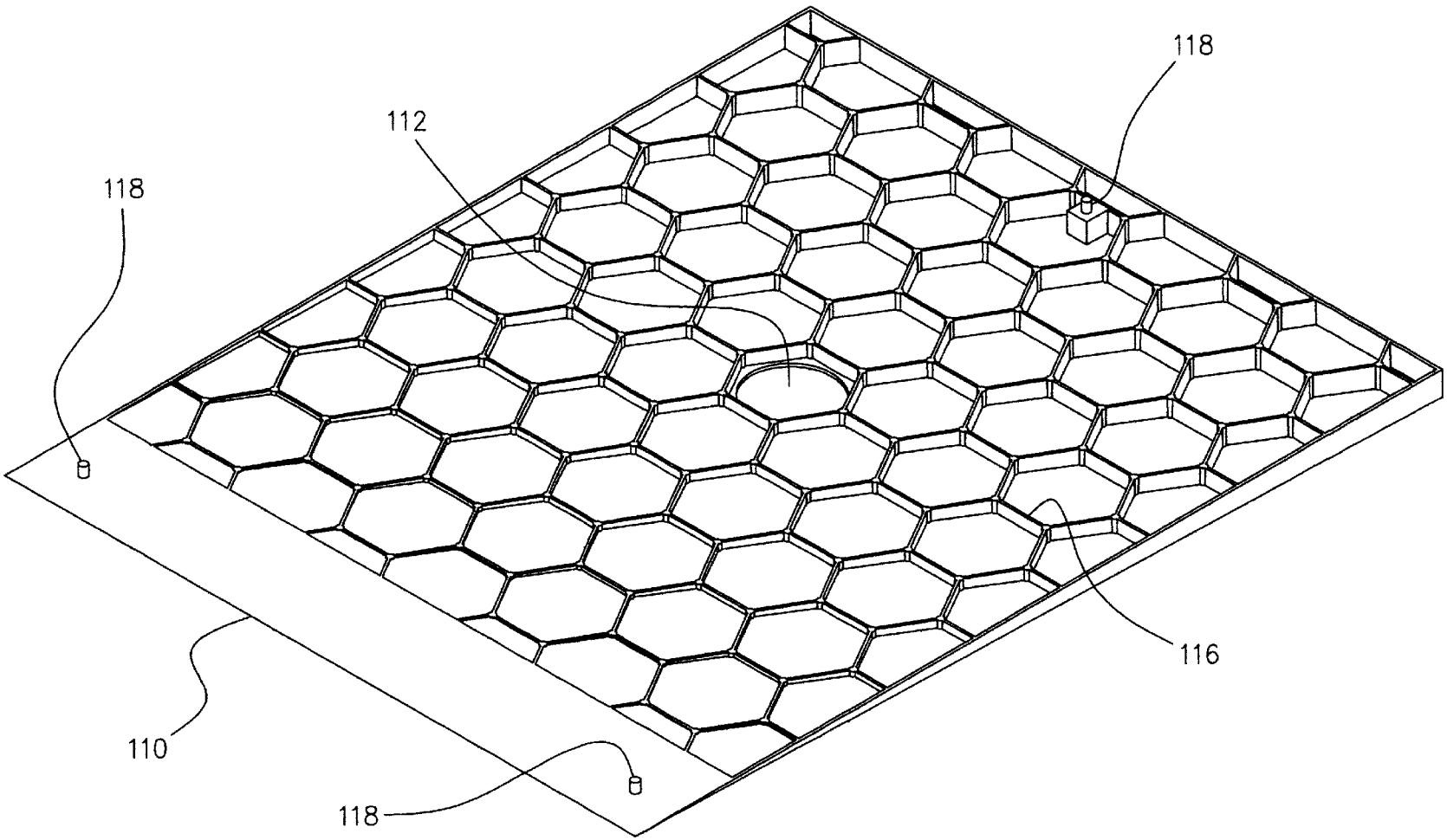
FIG. 24 is a bottom view of the molded polymeric or foam insert of FIG. 23.
Figure 25:
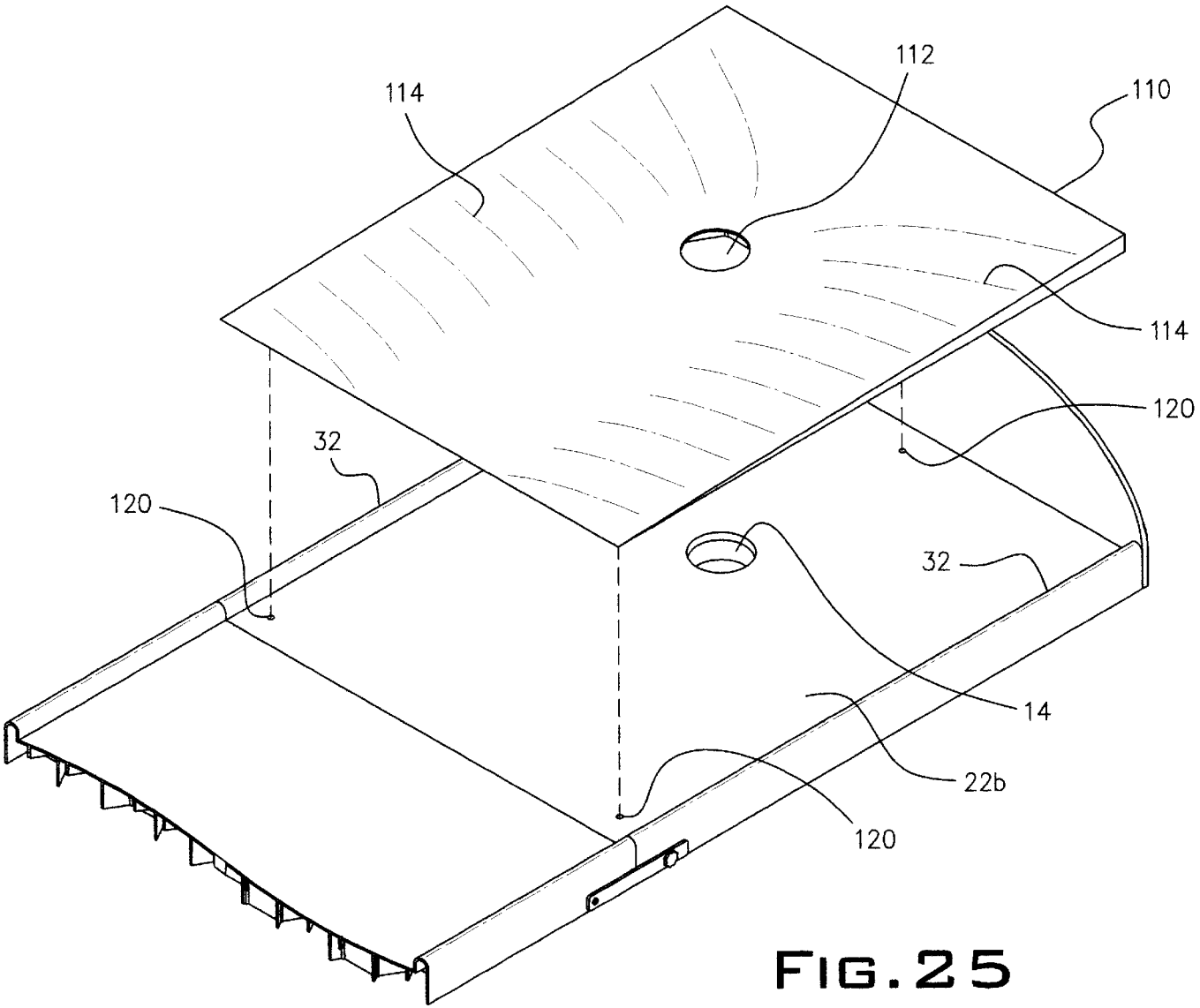
FIG. 25 is an exploded view of the molded polymeric or foam insert of FIG. 23 being mounted on a top surface of a front panel.

A raised pad 110 having a hole 112 conforming to cup hole 14 has contour lines 114 as seen in FIG. 23. This pad 110 is placed under the simulated grass 24 in panel 22B to provide an additional putting challenge to the golfer and more realistically simulate an actual putting surface. The pad 110 has a bottom shallow grid surface 116 and downwardly descending pins 118 to engage holes 120 on panel 22B.

Figure 26:
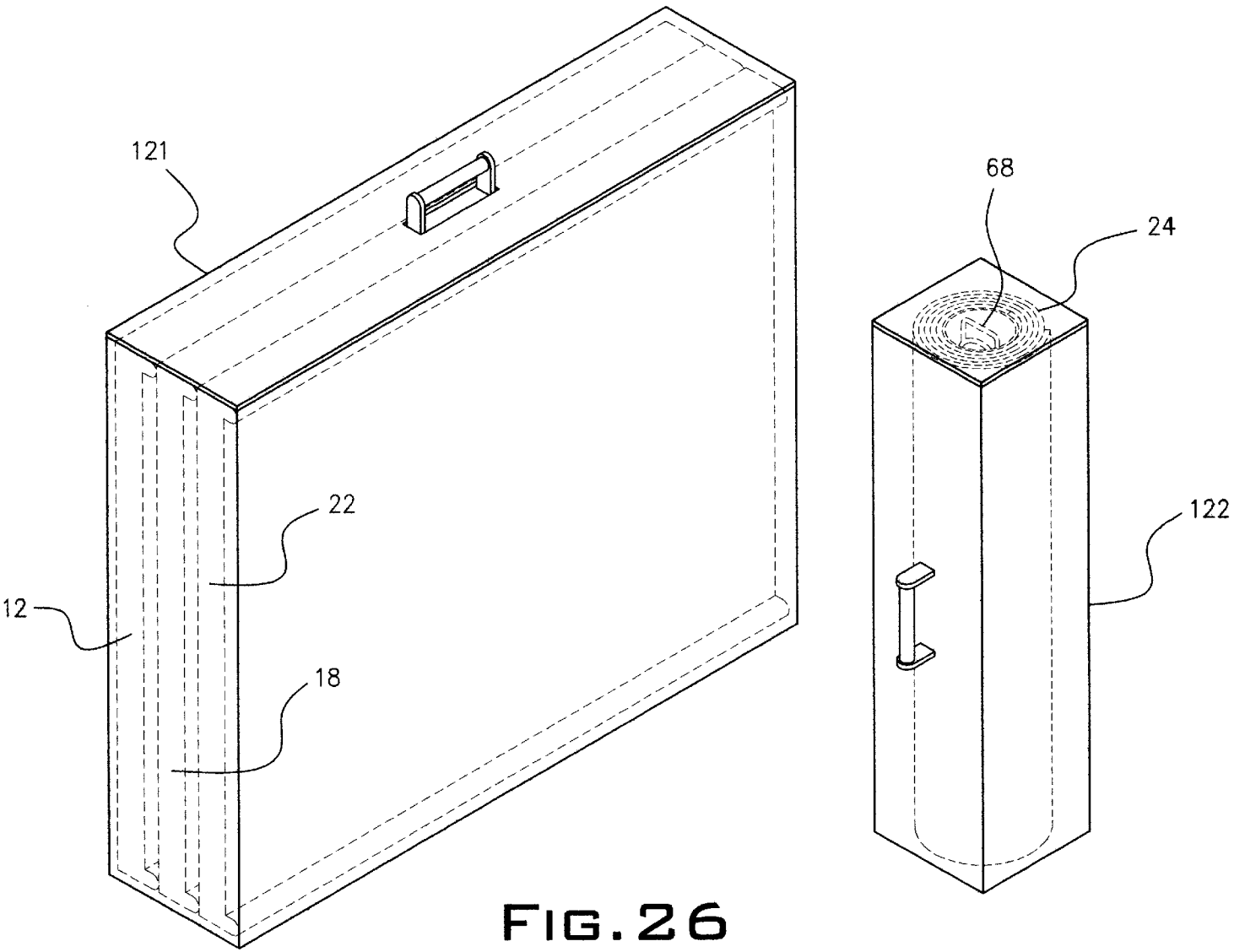
FIG. 26 is a perspective view of the carrying cases for a three panel unit and simulated turf.

The portable practice green 10 can be easily disassembled and carried away in a first carrying case 121. The three panels 12, 18 and 22 and backboard 56 of FIG. 10 are placed vertically within carrying case 121. The simulated turf 24 is rolled up and placed into a second carrying case 122 along with the flag stick 68, all as seen in FIG. 26.

Figure 27:
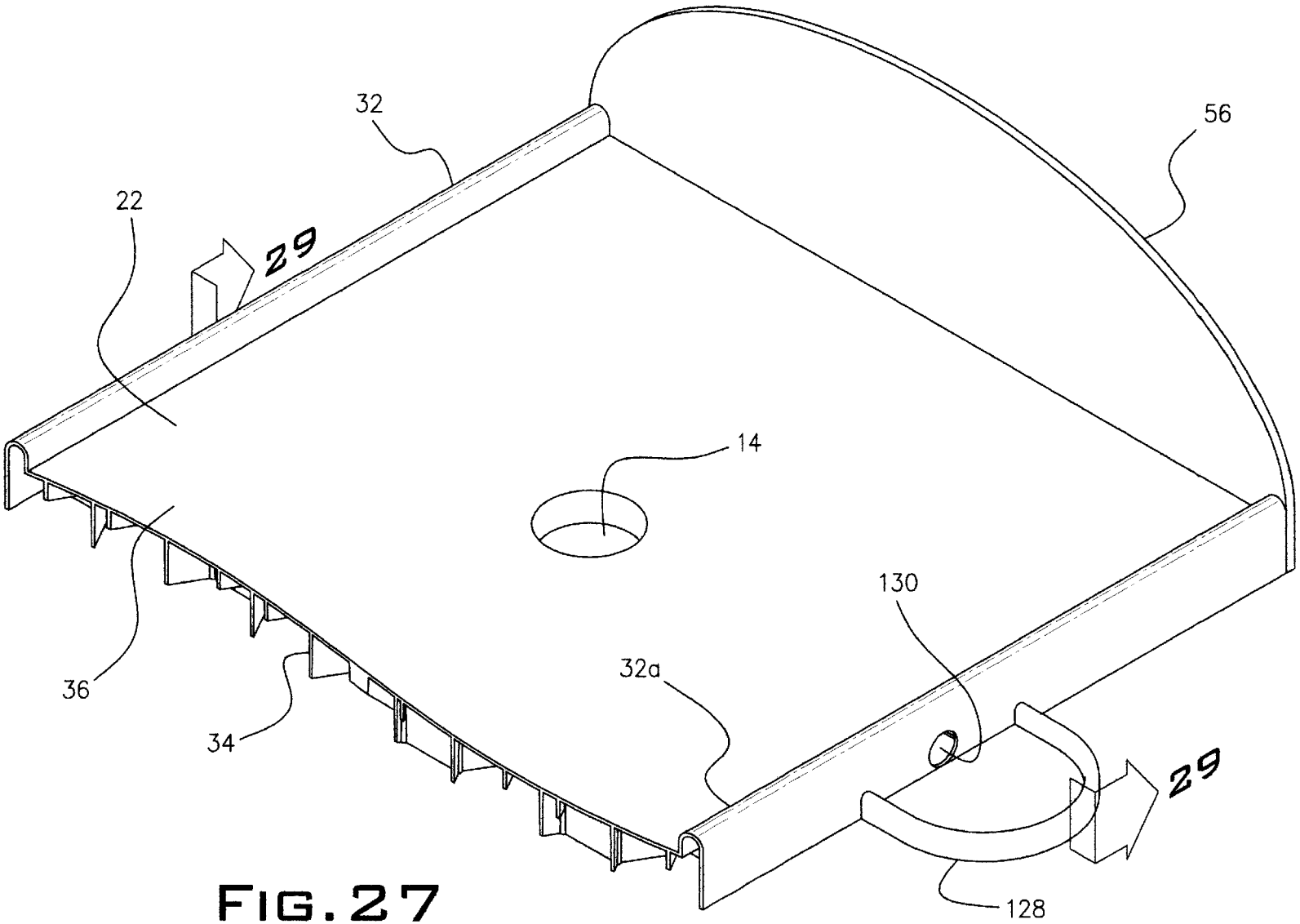
FIG. 27 is a cut-away perspective view of a rear panel employing a ball return.
Figure 28:
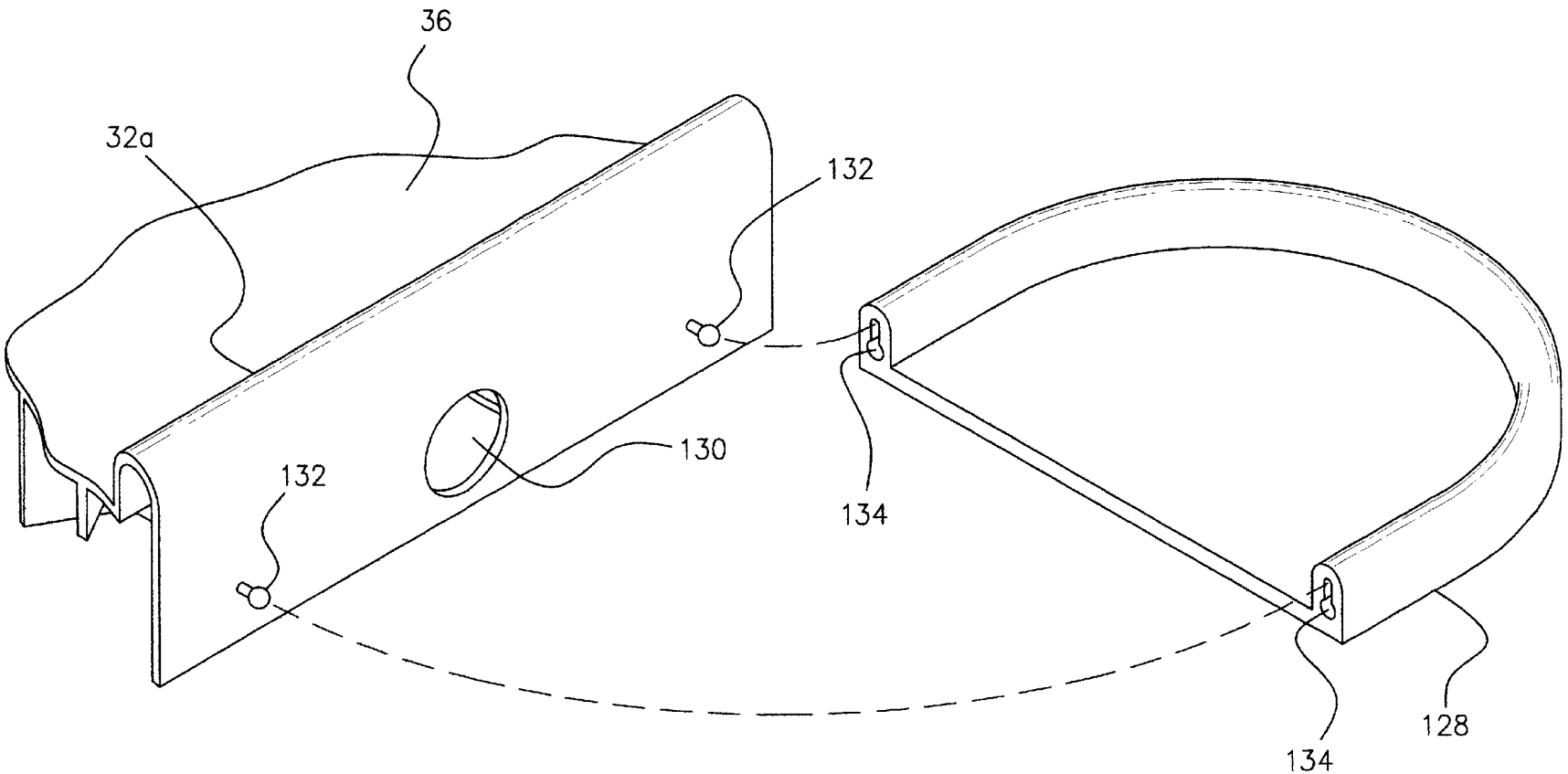
FIG. 28 is a view of the means of attaching the ball return receptacle to a side of the polymeric panel.
Figure 29:
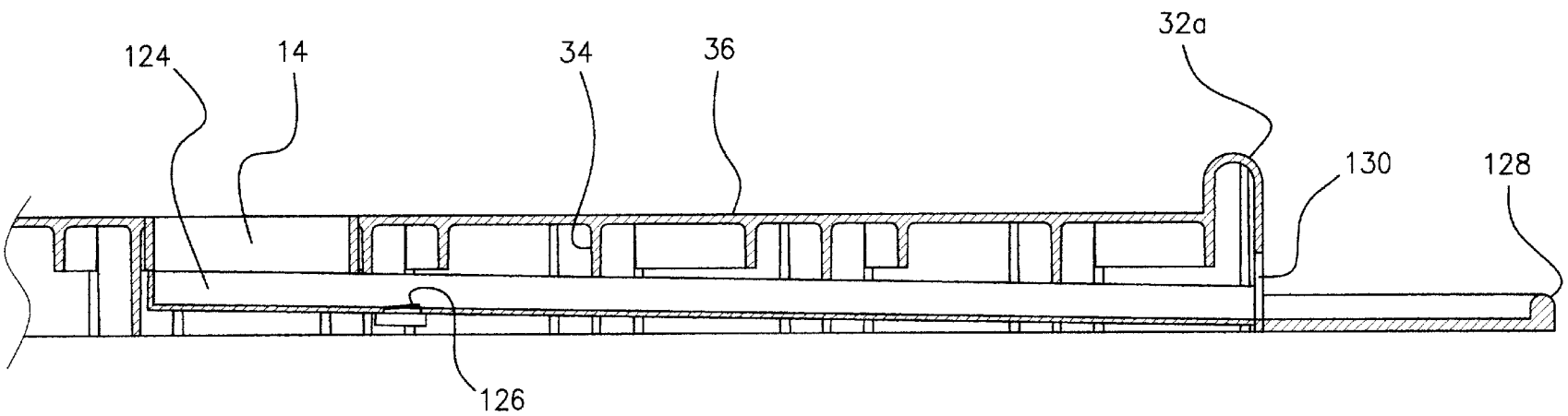
FIG. 29 is a sectional view along line 29—29 of FIG. 27.

As an auxiliary aid to the golfer, an optional ball return feature can be incorporated as seen in FIGS. 27–29. A ball trough 124 is molded into grid 34. A switch 126 can lead to a battery to activate sound to show that a golf ball passed over switch 126. The trough 124 leads to a ball return receptacle 128 mounted on a rolled side edge 32A. A hole 130 in side edge 32A allows the golf ball to exit the trough and land in receptacle 128. The receptacle 128 can be mounted on side edge 32A on nipples 132 by engagement with openings 134.

The above description has described specific structural details employing the invention. However, it will be within one having skill in the art to make modifications without departing from the spirit and scope of the underlying inventive concept of this portable golf putting training green. The invention is not limited to the structure described but includes such modifications as are substantially equivalent to the elements of the golf putting training green.

Having thus described the invention, what is claimed and desired to be secured by Letters Patent is:

1. A portable golf putting practice green comprising:

multiple molded polymeric panels mechanically joined together in a lengthwise configuration, each polymeric panel molded as a rigid integral body having a planar top surface and a grid structure open at a bottom surface supporting the top surface, each polymeric panel having a raised side edge with respect to the planar top surface;

means for mechanically attaching the multiple molded polymeric panels together;

a simulated grass layer covering the planar top surface of the attached multiple molded polymeric panels;

a cup molded in one of the multiple molded polymeric panels adapted to receive a golf ball; and a backboard attached to a front polymeric panel to prevent overshooting the front panel.

2. The portable golf putting practice green according to claim 1 wherein there are three polymeric panels.

3. The portable golf putting practice green according to claim 1 wherein the simulated grass is a synthetic turf.

4. The portable golf putting practice green according to claim 1 wherein the simulated grass is a carpet.

5. The portable golf putting practice green according to claim 1 wherein the means for mechanically attaching the molded polymeric panels is a bar pivoting at one end at a side of a first panel, the bar having a groove at a second end portion engaging a shaft of a threaded fastener attached to a side of a second adjacent panel.

6. The portable golf putting practice green according to claim 1 wherein the means for mechanically attaching the molded polymeric panels is a groove formed adjacent the raised side edge on the planar top surface at each edge and a metal bracket filling the grooves on adjacent panels and maintained in place by a fastener.

7. The portable golf putting practice green according to claim 1 wherein the means for mechanically attaching the molded polymeric panels is a slot formed in the raised side edge of two juxtaposed polymeric panels and a U-shaped plate having bores axially aligned with the slots fitted under a lower edge of the polymeric panels, and a threaded fastener inserted axially in each bore and the slot to lock the two polymeric panels together.

8. The portable golf putting practice green according to claim 1 wherein the means for mechanically attaching the molded polymeric panels is a cammed S-hook mounted in a side slot of a first polymeric panel engaged to a shelf in a corresponding side slot in a second abutting polymeric panel.

9. The portable golf putting practice green according to claim 1 wherein a rigid chipping platform having an integral top surface and supporting grid structure open at a bottom surface is spaced apart from the practice green.

10. The portable golf putting practice green according to claim 1 wherein a raised pad having contour lines and a hole corresponding to the cup molded in one of the multiple molded polymeric panels is mounted on the polymeric panel with the cup and hole axially aligned with a hole in the simulated grass layer mounted over the raised pad.

11. The portable golf putting practice green according to claim 1 wherein a ball return conduit is molded in the grid structure leading from the cup to a side edge of a polymeric panel containing a hole adapted to pass a golf ball into a receiving receptacle adjacent an outside side edge of the polymeric panel.

12. The portable golf putting practice green according to claim 2 wherein the three panels and the backboard are vertically mounted within a first carrying case and the simulated grass is rolled up and enclosed within a second carrying case.

13. A portable golf putting practice green comprising:

at least three polymeric panels mechanically joined together in a lengthwise configuration, each polymeric panel molded as a rigid integral body having a planar top surface and a bottom grid structure open at a bottom surface, each polymeric panel having a raised side edge with respect to the planar top surface;

a mechanical fastener joining each of the at least three polymeric panels together;

a simulated grass layer covering the planar top surface of the joined multiple molded polymeric panels;

a cup molded in one of the at least three polymeric panels adapted to receive a golf ball; and a backboard attached to a front panel to prevent a putted golf ball from leaving the practice green.

14. A portable golf putting practice green comprising:

a front, a middle and back polymeric panel mechanically joined together end to end in a lengthwise configuration with a backboard joined to a distal end of the front polymeric panel;

each of the front, middle and back polymeric panels molded as a rigid integral body having a planar top surface and a grid type bottom structure open at a bottom surface with a raised side edge on each side of a polymeric panel with respect to the planar top surface;

a simulated grass layer covering the planar top surface of the joined front, middle and back polymeric panels; and a golf cup molded in the front polymeric panel.

* * * * *